US007465363B2

(12) United States Patent
Sakamoto et al.

(10) Patent No.: US 7,465,363 B2
(45) Date of Patent: Dec. 16, 2008

(54) HARD MAGNETIC COMPOSITION, PERMANENT MAGNET POWDER, METHOD FOR PERMANENT MAGNET POWDER, AND BONDED MAGNET

(75) Inventors: Atsushi Sakamoto, Tokyo (JP); Makoto Nakane, Tokyo (JP); Hideki Nakamura, Tokyo (JP); Akira Fukuno, Tokyo (JP)

(73) Assignee: TDK Corporation, Tokyo (JP)

( * ) Notice: Subject to any disclaimer, the term of this patent is extended or adjusted under 35 U.S.C. 154(b) by 504 days.

(21) Appl. No.: 10/540,345

(22) PCT Filed: Jan. 28, 2004

(86) PCT No.: PCT/JP2004/000750

§ 371 (c)(1),
(2), (4) Date: Jun. 21, 2005

(87) PCT Pub. No.: WO2004/068513

PCT Pub. Date: Aug. 12, 2004

(65) Prior Publication Data

US 2006/0169360 A1 Aug. 3, 2006

(30) Foreign Application Priority Data

| | | |
|---|---|---|
| Jan. 28, 2003 | (JP) | 2003-019446 |
| Feb. 3, 2003 | (JP) | 2003-026077 |
| Mar. 28, 2003 | (JP) | 2003-092892 |
| Dec. 18, 2003 | (JP) | 2003-421463 |

(51) Int. Cl.
*H01F 1/058* (2006.01)
*H01F 1/059* (2006.01)

(52) U.S. Cl. ..... 148/301; 148/315

(58) Field of Classification Search ..... None
See application file for complete search history.

(56) References Cited

U.S. PATENT DOCUMENTS

| | | | | |
|---|---|---|---|---|
| 5,480,495 | A | 1/1996 | Sakurada et al. | |
| 5,769,969 | A * | 6/1998 | Ishikawa et al. | 148/301 |
| 5,800,728 | A * | 9/1998 | Iwata | 252/62.53 |
| 6,302,939 | B1 * | 10/2001 | Rabin et al. | 75/338 |

(Continued)

FOREIGN PATENT DOCUMENTS

| | | |
|---|---|---|
| CN | 1059230 | 3/1992 |

(Continued)

OTHER PUBLICATIONS

European Search Report for corresponding European application No. 047059167.7 lists the reference above.

*Primary Examiner*—John P. Sheehan
(74) *Attorney, Agent, or Firm*—Hogan & Hartson LLP

(57) ABSTRACT

A single phase consisting of a $ThMn_{12}$ phase can be obtained by having the composition thereof represented by a general formula $R(Fe_{100-y-w}Co_wTi_y)_xSi_zA_v$ (in the general formula, R is at least one element selected from rare earth elements (here the rare earth elements signify a concept inclusive of Y), Nd accounts for 50 mol % or more of R, and A is N and/or C) in which the molar ratios in the general formula are such that x=10 to 12.5, y=(8.3−1.7×z) to 12.3, z=0.1 to 2.3, v=0.1 to 3 and w=0 to 30, and the relation (Fe+Co+Ti+Si)/R>12 is satisfied.

18 Claims, 31 Drawing Sheets

U.S. PATENT DOCUMENTS

| | | | | |
|---|---|---|---|---|
| 6,419,759 | B1 * | 7/2002 | Yang et al. | 148/302 |
| 2003/0019546 | A1 * | 1/2003 | Kanekiyo et al. | 148/105 |
| 2004/0079449 | A1 * | 4/2004 | Kanekiyo et al. | 148/302 |
| 2004/0194856 | A1 * | 10/2004 | Miyoshi et al. | 148/105 |

FOREIGN PATENT DOCUMENTS

| | | | |
|---|---|---|---|
| EP | 0493019 | A2 | 1/1992 |
| JP | 05062815 | A | 3/1993 |
| JP | 06235051 | A | 8/1994 |

* cited by examiner

Figure 2

| Sample No. | Ti (y) | Fe+Ti (x) | Si (z) | N (v) | Co (w) | σs [emu/g] | HA [kOe] | Fe+Ti+Si (x+z) | Lower limit for Ti 8.3−1.7z | Phases |
|---|---|---|---|---|---|---|---|---|---|---|
| 1 | 8.3 | 11.9 | 0.2 | 1.6 | 0 | 143.8 | 51.5 | 12.1 | 8.0 | Single phase (only 1−12 phase) |
| 2 | 8.2 | 11.9 | 0.5 | 1.5 | 0 | 143.5 | 52.1 | 12.4 | 7.5 | |
| 3 | 8.2 | 12.1 | 1.0 | 1.5 | 0 | 140.8 | 55.4 | 13.1 | 6.6 | |
| 4 | 8.2 | 12.0 | 1.5 | 1.3 | 0 | 138.2 | 58.2 | 13.5 | 5.8 | |
| 5 | 8.1 | 11.9 | 2.0 | 1.4 | 0 | 136.8 | 59.8 | 13.9 | 4.9 | |
| 6 | 8.3 | 12.1 | 0 | 1.4 | 0 | 141.8 | 28.9 | 12.1 | 8.3 | 1−12 Phase, 2−17 phase, α−Fe phase |
| 7 | 8.3 | 12.1 | 2.5 | 1.4 | 0 | 129.5 | 35.7 | 14.6 | 4.1 | 1−12 Phase, α−Fe |
| 8 | 8.2 | 9.8 | 2.5 | 1.5 | 0 | 115.2 | 29.8 | 12.3 | 4.1 | Single phase (only 1−12 phase) |

Figure 6

| Sample No. | Ti (y) | Fe+Ti (x) | Si (z) | N (v) | Co (w) | σs [emu/g] | HA [kOe] | Fe+Ti+Si (x+z) | Lower limit for Ti 8.3−1.7z | Phases |
|---|---|---|---|---|---|---|---|---|---|---|
| 9 | 8.0 | 11.2 | 1.0 | 1.6 | 0 | 130.0 | 54.6 | 12.2 | 6.6 | Single phase (only 1−12 phase) |
| 10 | 8.3 | 12.2 | 1.0 | 1.5 | 0 | 142.7 | 55.1 | 13.2 | 6.6 | |
| 11 | 8.3 | 12.5 | 1.0 | 1.5 | 0 | 145.2 | 54.9 | 13.5 | 6.6 | |
| 12 | 8.2 | 10.1 | 2.0 | 1.6 | 0 | 121.6 | 57.4 | 12.1 | 4.9 | |
| 13 | 8.1 | 10.5 | 1.9 | 1.5 | 0 | 124.8 | 59.0 | 12.4 | 5.1 | |
| 14 | 8.1 | 10.9 | 1.9 | 1.5 | 0 | 127.4 | 58.6 | 12.8 | 5.1 | |
| 15 | 8.0 | 12.2 | 2.0 | 1.4 | 0 | 135.9 | 58.9 | 14.2 | 4.9 | |
| 16 | 8.2 | 12.5 | 2.0 | 1.5 | 0 | 138.2 | 58.4 | 14.5 | 4.9 | |
| 17 | 8.3 | 9.5 | 1.1 | 1.5 | 0 | 116.8 | 30.2 | 10.6 | 6.4 | Single phase (only 1−12 phase) |
| 18 | 8.3 | 10.0 | 1.0 | 1.4 | 0 | 118.0 | 32.0 | 11.0 | 6.6 | |
| 19 | 8.2 | 10.5 | 1.0 | 1.5 | 0 | 119.2 | 33.9 | 11.5 | 6.6 | |
| 20 | 8.3 | 12.7 | 1.0 | 1.6 | 0 | 145.9 | 46.2 | 13.7 | 6.6 | 1−12 Phase, α−Fe |
| 21 | 8.1 | 9.5 | 2.0 | 1.6 | 0 | 114.8 | 49.5 | 11.5 | 4.9 | Single phase (only 1−12 phase) |
| 22 | 8.3 | 12.7 | 2.0 | 1.6 | 0 | 137.8 | 45.8 | 14.7 | 4.9 | 1−12 Phase, α−Fe |

Figure 9

| Sample No. | Ti (y) | Fe+Ti (x) | Si (z) | N (v) | Co (w) | σs [emu/g] | HA [kOe] | Fe+Ti+Si (x+z) | Lower limit for Ti 8.3−1.7z | Phases |
|---|---|---|---|---|---|---|---|---|---|---|
| 23 | 6.6 | 12.1 | 1.0 | 1.3 | 0 | 145.0 | 57.1 | 13.1 | 6.6 | Single phase (only 1−12 phase) |
| 24 | 7.5 | 12.1 | 1.0 | 1.5 | 0 | 143.8 | 57.0 | 13.1 | 6.6 | |
| 25 | 10.0 | 11.9 | 1.0 | 1.5 | 0 | 135.1 | 50.3 | 12.9 | 6.6 | |
| 26 | 5.8 | 12.2 | 1.5 | 1.4 | 0 | 146.2 | 62.0 | 13.7 | 5.8 | |
| 27 | 6.7 | 12.0 | 1.5 | 1.4 | 0 | 143.0 | 61.8 | 13.5 | 5.8 | |
| 28 | 7.5 | 11.9 | 1.5 | 1.5 | 0 | 141.2 | 60.4 | 13.4 | 5.8 | |
| 29 | 4.9 | 11.9 | 2.0 | 1.4 | 0 | 142.5 | 63.8 | 13.9 | 4.9 | |
| 30 | 5.8 | 12.1 | 2.0 | 1.4 | 0 | 142.0 | 63.0 | 14.1 | 4.9 | |
| 31 | 6.7 | 12.0 | 2.0 | 1.5 | 0 | 141.9 | 62.8 | 14.0 | 4.9 | |
| 32 | 7.5 | 11.9 | 2.0 | 1.5 | 0 | 139.5 | 61.1 | 13.9 | 4.9 | |
| 33 | 5.0 | 12.0 | 1.0 | 1.5 | 0 | 138.2 | 29.0 | 13.0 | 6.6 | 1−12 Phase, 2−17 phase, α−Fe phase |
| 34 | 5.8 | 12.1 | 1.0 | 1.5 | 0 | 139.7 | 41.6 | 13.1 | 6.6 | 1−12 Phase, α−Fe |
| 35 | 12.5 | 12.2 | 1.0 | 1.4 | 0 | 118.0 | 44.1 | 13.2 | 6.6 | Single phase (only 1−12 phase) |
| 36 | 4.2 | 12.0 | 1.5 | 1.5 | 0 | 128.5 | 29.5 | 13.5 | 5.8 | 1−12 Phase, 2−17 phase, α−Fe phase |
| 37 | 5.0 | 12.2 | 1.5 | 1.5 | 0 | 135.0 | 45.3 | 13.7 | 5.8 | 1−12 Phase, α−Fe |
| 38 | 3.3 | 12.1 | 2.0 | 1.5 | 0 | 135.8 | 52.8 | 14.1 | 4.9 | 1−12 Phase, α−Fe |

Figure 13

| Sample No. | Ti (y) | Fe+Ti (x) | Si (z) | N (v) | Co (w) | σs [emu/g] | HA [kOe] | Fe+Ti+Si (x+z) | Lower limit for Ti 8.3−1.7z | Phases |
|---|---|---|---|---|---|---|---|---|---|---|
| 39 | 8.3 | 12.2 | 1.1 | 0.4 | 0 | 125.2 | 35.2 | 13.3 | 6.4 | Single phase (only 1−12 phase) |
| 40 | 8.2 | 12.0 | 1.1 | 1.0 | 0 | 134.2 | 45.9 | 13.1 | 6.4 | |
| 41 | 8.2 | 11.9 | 1.0 | 1.9 | 0 | 139.8 | 56.8 | 12.9 | 6.6 | |
| 42 | 8.1 | 11.9 | 1.0 | 2.5 | 0 | 137.2 | 55.1 | 12.9 | 6.6 | |
| 43 | 8.2 | 12.2 | 1.0 | 0.0 | 0 | 116.4 | 17.1 | 13.2 | 6.6 | Single phase (only 1−12 phase) |
| 44 | 8.3 | 12.0 | 1.0 | 3.5 | 0 | 128.4 | 32.4 | 13.0 | 6.6 | 1−12 Phase, α−Fe |

Figure 15

| Sample No. | Ti (y) | Fe+Ti (x) | Si (z) | N (v) | Co (w) | σs [emu/g] | HA [kOe] | Fe+Co+Ti+Si (x+z) | Lower limit for Ti 8.3−1.7z | Phases |
|---|---|---|---|---|---|---|---|---|---|---|
| 45 | 8.2 | 12.1 | 0.25 | 1.6 | 9.1 | 155.2 | 54.1 | 12.4 | 7.9 | Single phase (only 1−12 phase) |
| 46 | 8.1 | 12.0 | 0.25 | 1.5 | 18.2 | 161.5 | 56.3 | 12.3 | 7.9 | |
| 47 | 8.1 | 12.0 | 0.25 | 1.7 | 27.3 | 159.3 | 54.5 | 12.3 | 7.9 | |
| 48 | 8.2 | 12.0 | 1.0 | 1.5 | 9.1 | 148.3 | 57.2 | 13.0 | 6.6 | |
| 49 | 8.1 | 12.0 | 1.0 | 1.6 | 18.2 | 152.7 | 59.6 | 13.0 | 6.6 | |
| 50 | 8.1 | 12.0 | 1.0 | 1.5 | 27.3 | 149.3 | 58.6 | 13.0 | 6.6 | |

Figure 16

| Sample No. | Ti (y) | Fe+Ti (x) | Si (z) | C (v) | Co (w) | σs [emu/g] | HA [kOe] | Fe+Co+Ti+Si (x+z) | Lower limit for Ti 8.3−1.7z | Phases |
|---|---|---|---|---|---|---|---|---|---|---|
| 51 | 8.2 | 12.1 | 0.25 | 1.5 | 0 | 140.2 | 43.5 | 12.4 | 7.9 | Single phase (only 1−12 phase) |
| 52 | 8.3 | 12.2 | 1.0 | 1.5 | 0 | 138.5 | 44.8 | 13.2 | 6.6 | |
| 53 | 8.3 | 12.0 | 2.0 | 1.5 | 0 | 132.6 | 38.5 | 14.0 | 4.9 | |
| 54 | 8.2 | 12.2 | 0.25 | 1.5 | 19.2 | 152.3 | 47.5 | 12.5 | 7.9 | |
| 55 | 8.2 | 12.0 | 0.25 | 2.0 | 0 | 138.6 | 41.3 | 12.3 | 7.9 | |
| 56 | 8.3 | 12.1 | 1.0 | 2.0 | 0 | 135.2 | 42.9 | 13.1 | 6.6 | |
| 57 | 8.2 | 12.1 | 2.0 | 2.0 | 0 | 129.5 | 37.1 | 14.1 | 4.9 | |
| 58 | 8.3 | 12.0 | 0.25 | 2.0 | 18.3 | 150.9 | 45.5 | 12.3 | 7.9 | |
| 59 | 8.2 | 12.2 | 1.0 | 0 | 0 | 116.4 | 17.1 | 13.2 | 6.6 | |

Figure 17

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 60 | 0.00 | 8.3 | 12.0 | 1.0 | 2.3 | 0 | 139.4 | 56.2 | 13.0 | Single phase (only 1-12 phase) |
| 61 | 0.02 | 8.2 | 12.1 | 1.0 | 1.7 | 0 | 142.2 | 55.8 | 13.1 | |
| 62 | 0.04 | 8.2 | 12.0 | 0.9 | 1.8 | 0 | 144.6 | 55.0 | 12.9 | |
| 63 | 0.05 | 8.2 | 12.2 | 0.9 | 1.6 | 0 | 145.6 | 55.1 | 13.1 | |
| 64 | 0.06 | 8.2 | 12.1 | 1.0 | 1.6 | 0 | 144.5 | 55.1 | 13.1 | |
| 65 | 0.08 | 8.2 | 11.8 | 1.0 | 1.7 | 0 | 143.9 | 55.4 | 12.8 | |
| 66 | 0.10 | 8.3 | 12.0 | 0.9 | 1.6 | 0 | 142.5 | 53.9 | 12.9 | |
| 67 | 0.15 | 8.2 | 11.9 | 1.0 | 1.7 | 0 | 141.0 | 53.2 | 12.9 | |
| 68 | 0.20 | 8.2 | 11.9 | 1.0 | 2.2 | 0 | 139.1 | 52.9 | 12.9 | 1-12 Phase, α-Fe Phase |

Figure 20

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 69 | 0.05 | 8.3 | 12.1 | 0.0 | 1.4 | 0 | 142.1 | 28.9 | 12.1 | 1-12 Phase, 2-17 phase, α-Fe phase |
| 70 | 0.05 | 8.3 | 11.9 | 0.2 | 1.6 | 0 | 148.8 | 51.5 | 12.1 | Single phase (only 1-12 phase) |
| 71 | 0.05 | 8.2 | 11.9 | 0.5 | 1.5 | 0 | 148.5 | 52.1 | 12.4 | |
| 72 | 0.05 | 8.2 | 12.0 | 1.5 | 1.3 | 0 | 143.2 | 58.2 | 13.5 | |
| 73 | 0.05 | 8.1 | 11.9 | 2.0 | 1.4 | 0 | 141.8 | 59.8 | 13.9 | |
| 74 | 0.05 | 8.3 | 12.1 | 2.5 | 1.4 | 0 | 134.7 | 35.7 | 14.6 | 1-12 Phase, α-Fe Phase |

Figure 21

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 75 | 0.05 | 8.2 | 11.5 | 0.5 | 1.8 | 0 | 144.9 | 49.5 | 12.0 | 1-12 Phase, NdN phase |
| 76 | 0.05 | 8.3 | 11.9 | 0.5 | 1.5 | 0 | 148.5 | 52.1 | 12.4 | Single phase (only 1-12 phase) |
| 77 | 0.05 | 8.2 | 12.5 | 0.5 | 1.6 | 0 | 151.4 | 51.8 | 13.0 | 1-12 Phase, α-Fe Phase |
| 78 | 0.05 | 8.0 | 11.1 | 1.0 | 1.6 | 0 | 140.2 | 54.6 | 12.1 | 1-12 Phase, NdN phase |
| 79 | 0.05 | 8.3 | 12.2 | 1.0 | 1.5 | 0 | 147.7 | 55.1 | 13.2 | Single phase (only 1-12 phase) |
| 80 | 0.05 | 8.3 | 12.5 | 1.0 | 1.5 | 0 | 150.8 | 54.9 | 13.5 | 1-12 Phase, α-Fe Phase |
| 81 | 0.05 | 8.2 | 10.5 | 0.5 | 1.5 | 0 | 135.2 | 35.1 | 11.0 | Single phase (only 1-12 phase) |
| 82 | 0.05 | 8.3 | 11.1 | 0.5 | 1.6 | 0 | 140.2 | 37.5 | 11.6 | |
| 83 | 0.05 | 8.3 | 10.0 | 1.0 | 1.4 | 0 | 128.7 | 37.4 | 11.0 | |
| 84 | 0.05 | 8.2 | 10.5 | 1.0 | 1.5 | 0 | 132.5 | 39.7 | 11.5 | |
| 85 | 0.05 | 8.3 | 13.0 | 1.0 | 1.6 | 0 | 148.5 | 35.8 | 14.0 | 1-12 Phase, α-Fe Phase |
| 86 | 0.05 | 8.3 | 10.0 | 1.5 | 1.6 | 0 | 124.2 | 36.2 | 11.5 | 1-12 Phase, 2-17 phase, α-Fe phase |

Figure 22

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 87 | 0.05 | 6.6 | 12.1 | 1.0 | 1.3 | 0 | 150.5 | 57.1 | 13.1 | Single phase (only 1-12 phase) |
| 88 | 0.05 | 7.5 | 12.1 | 1.0 | 1.5 | 0 | 149.1 | 57.0 | 13.1 | |
| 89 | 0.05 | 10.0 | 11.9 | 1.0 | 1.5 | 0 | 140.2 | 50.3 | 12.9 | |
| 90 | 0.05 | 12.5 | 12.2 | 1.0 | 1.4 | 0 | 123.1 | 44.1 | 13.2 | |
| 91 | 0.05 | 5.8 | 12.2 | 1.5 | 1.4 | 0 | 152.4 | 62.0 | 13.7 | 1-12 Phase, α-Fe Phase |
| 92 | 0.05 | 6.7 | 12.0 | 1.5 | 1.4 | 0 | 147.6 | 61.8 | 13.5 | Single phase (only 1-12 phase) |
| 93 | 0.05 | 7.5 | 11.9 | 1.5 | 1.5 | 0 | 146.0 | 60.4 | 13.4 | |
| 94 | 0.05 | 4.2 | 12.0 | 1.5 | 1.5 | 0 | 129.2 | 29.5 | 13.5 | 1-12 Phase, α-Fe Phase |
| 95 | 0.05 | 5.0 | 11.9 | 2.0 | 1.4 | 0 | 147.5 | 63.8 | 13.9 | Single phase (only 1-12 phase) |
| 96 | 0.05 | 5.8 | 12.1 | 2.0 | 1.4 | 0 | 147.0 | 63.0 | 14.1 | |
| 97 | 0.05 | 6.7 | 12.0 | 2.0 | 1.5 | 0 | 147.3 | 62.8 | 14.0 | |
| 98 | 0.05 | 7.5 | 11.9 | 2.0 | 1.5 | 0 | 145.2 | 61.1 | 13.9 | |
| 99 | 0.05 | 3.3 | 12.1 | 2.0 | 1.5 | 0 | 138.5 | 45.3 | 14.1 | 1-12 Phase, 2-17 phase, α-Fe phase |

Figure 23

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 100 | 0.05 | 8.2 | 12.2 | 1.0 | 0.0 | 0 | 116.1 | 17.1 | 13.2 | Single phase (only 1-12 phase) |
| 101 | 0.05 | 8.3 | 12.2 | 1.1 | 0.4 | 0 | 130.2 | 35.2 | 13.3 | |
| 102 | 0.05 | 8.2 | 12.0 | 1.1 | 1.0 | 0 | 141.7 | 45.9 | 13.1 | |
| 103 | 0.05 | 8.2 | 11.9 | 1.0 | 1.9 | 0 | 144.2 | 56.8 | 12.9 | |
| 104 | 0.05 | 8.1 | 11.9 | 1.0 | 2.5 | 0 | 142.8 | 55.1 | 12.9 | |
| 105 | 0.05 | 8.3 | 12.0 | 1.0 | 3.5 | 0 | 134.2 | 32.4 | 13.0 | 1-12 Phase, NdN phase, α-Fe phase |

Figure 24

| Sample No. | Zr (u) | Ti (y) | Fe+Co+Ti (x) | Si (z) | N (v) | Co (w) | σs [emu/g] | HA [kOe] | Fe+Co+Ti+Si (x+z) | Phases |
|---|---|---|---|---|---|---|---|---|---|---|
| 106 | 0.05 | 8.2 | 12.1 | 0.25 | 1.6 | 9.1 | 160.5 | 54.1 | 12.4 | Single phase (only 1-12 phase) |
| 107 | 0.05 | 8.1 | 12.0 | 0.25 | 1.5 | 18.2 | 166.2 | 56.3 | 12.3 | |
| 108 | 0.05 | 8.1 | 12.0 | 0.25 | 1.7 | 27.3 | 164.5 | 54.5 | 12.3 | |
| 109 | 0.05 | 8.2 | 12.0 | 1.0 | 1.5 | 9.1 | 153.4 | 57.2 | 13.0 | |
| 110 | 0.05 | 8.1 | 12.0 | 1.0 | 1.6 | 18.2 | 157.4 | 59.6 | 13.0 | |
| 111 | 0.05 | 8.1 | 12.0 | 1.0 | 1.5 | 27.3 | 154.9 | 58.6 | 13.0 | |

Figure 25

| Sample No. | Zr (u) | Ti (y) | Fe+Co+Ti (x) | Si (z) | C (v) | Co (w) | σs [emu/g] | HA [kOe] | Fe+Co+Ti+Si (x+z) | Phases |
|---|---|---|---|---|---|---|---|---|---|---|
| 112 | 0.05 | 8.2 | 12.1 | 0.25 | 1.5 | 0 | 145.2 | 43.5 | 12.4 | Single phase (only 1-12 phase) |
| 113 | 0.05 | 8.3 | 12.2 | 1 | 1.5 | 0 | 143.2 | 44.8 | 13.2 | |
| 114 | 0.05 | 8.2 | 12.2 | 0.25 | 1.5 | 19.2 | 157.0 | 47.5 | 12.5 | 1-12 Phase, α-Fe Phase |
| 115 | 0.05 | 8.2 | 12.0 | 0.25 | 2.0 | 0 | 143.5 | 41.3 | 12.3 | Single phase (only 1-12 phase) |
| 116 | 0.05 | 8.3 | 12.1 | 1 | 2.0 | 0 | 140.1 | 42.9 | 13.1 | |
| 117 | 0.05 | 8.3 | 12.0 | 0.25 | 2.0 | 18.3 | 156.0 | 49.2 | 12.3 | |

Figure 26

| Sample No. | Hf (u) | Ti (y) | Fe+Co+Ti (x) | Si (z) | C (v) | Co (w) | σs [emu/g] | HA [kOe] | Fe+Co+Ti+Si (x+z) | Phases |
|---|---|---|---|---|---|---|---|---|---|---|
| 118 | 0.02 | 8.2 | 11.9 | 1.0 | 1.7 | 0 | 140.5 | 53.1 | 12.9 | Single phase (only 1-12 phase) |
| 119 | 0.05 | 8.2 | 12.0 | 0.9 | 1.7 | 0 | 144.2 | 52.0 | 12.9 | |
| 120 | 0.10 | 8.3 | 11.9 | 1.0 | 1.8 | 0 | 141.1 | 53.5 | 12.9 | |

Figure 27

| Sample No. | Ti (y) | Fe+Ti (x) | Si (z) | N (v) | σs [emu/g] | HA [kOe] | c/a | Tc (°C) | Phases |
|---|---|---|---|---|---|---|---|---|---|
| 121 | 8.2 | 11.9 | 0.25 | 1.5 | 144.1 | 51.7 | 0.559 | 441 | Single phase (only 1-12 phase) |
| 122 | | | 0.50 | | 143.5 | 52.1 | 0.561 | 438 | |
| 123 | | | 1.00 | | 138.8 | 55.1 | 0.562 | 433 | |
| 124 | | | 1.50 | | 138.0 | 58.1 | 0.562 | 433 | |
| 125 | | | 2.00 | | 135.9 | 59.0 | 0.562 | 431 | |
| 126 | | | 2.50 | | 129.5 | 40.7 | 0.561 | 467 | |
| 127 | 8.3 | 12.0 | 0.50 | 1.0 | 137.0 | 44.1 | 0.560 | 426 | |
| 128 | | | 1.50 | 1.1 | 132.8 | 49.7 | 0.561 | 412 | |
| 129 | 8.2 | 11.9 | — | 1.5 | 138.2 | 28.1 | 0.552 | 442 | |
| 130 | | | 1.50 | — | 115.3 | 20.2 | — | 269 | |
| 131 | | | 3.00 | 1.5 | 123.2 | 27.1 | 0.556 | 467 | 1-12 Phase, α-Fe |
| 132 | 8.3 | 12.0 | 3.05 | 0.7 | 125.1 | 21.5 | — | 389 | |

Figure 29

| Sample No. | Ti (y) | Fe+Ti (x) | Si (z) | N (v) | σs [emu/g] | HA [kOe] | Fe+Ti+Si (x+z) | c/a | Phases |
|---|---|---|---|---|---|---|---|---|---|
| 133 | 8.2 | 10.1 | 2.0 | 1.6 | 121.6 | 57.4 | 12.1 | 0.562 | Single phase (only 1-12 phase) |
| 134 | 8.1 | 10.5 | 1.9 | 1.5 | 124.8 | 59.0 | 12.4 | 0.562 | |
| 135 | 8.1 | 10.9 | 1.9 | 1.5 | 127.4 | 58.6 | 12.8 | 0.562 | |
| 136 | 8.0 | 12.2 | 2.0 | 1.4 | 135.9 | 58.9 | 14.2 | 0.561 | |
| 137 | 8.2 | 12.5 | 2.0 | 1.5 | 138.2 | 58.4 | 14.5 | 0.561 | |
| 138 | 8.3 | 12.7 | 2.0 | 1.6 | 137.8 | 45.8 | 14.7 | - | 1-12 Phase, α-Fe |

Figure 34

| | Roll peripheral velocity (m/s) | Step | σr (emu/g) | Hcj (Oe) |
|---|---|---|---|---|
| Present invention | 15 | After quenching | 26 | 500 |
| | | After heat treatment | 31 | 620 |
| | | After nitriding | 36 | 2,150 |
| | 25 | After quenching | 12 | 120 |
| | | After heat treatment | 44 | 920 |
| | | After nitriding | 86 | 7,920 |
| | 50 | After quenching | 12 | 80 |
| | | After heat treatment | 45 | 980 |
| | | After nitriding | 88 | 8,100 |
| | 75 | After quenching | 8 | 80 |
| | | After heat treatment | 51 | 1,010 |
| | | After nitriding | 84 | 7,860 |
| Comparative example | Cast alloy | After casting | 10 | 120 |
| | | — | | |
| | | After nitriding | 24 | 400 |

Figure 35

| Sample No. | Ti (y) | Fe+Ti (x) | Si (z) | N (v) | Co (w) | Fe+Ti+Si (x+z) | Lower limit for Ti 8.3−1.7z | σr [emu/g] | Hcj (Oe) |
|---|---|---|---|---|---|---|---|---|---|
| 139 | 8.3 | 11.9 | 0.2 | 1.6 | 0 | 12.1 | 8.0 | 79 | 5,880 |
| 140 | 8.1 | 11.9 | 2.0 | 1.4 | 0 | 13.9 | 4.9 | 75 | 7,900 |
| 141 | 8.0 | 11.2 | 1.0 | 1.6 | 0 | 12.2 | 6.6 | 72 | 6,600 |
| 142 | 8.2 | 10.1 | 2.0 | 1.6 | 0 | 12.1 | 4.9 | 67 | 7,300 |
| 143 | 8.2 | 12.5 | 2.0 | 1.5 | 0 | 14.5 | 4.9 | 76 | 7,560 |
| 144 | 6.6 | 12.1 | 1.0 | 1.3 | 0 | 13.1 | 6.6 | 80 | 7,220 |
| 145 | 6.7 | 12.0 | 1.5 | 1.4 | 0 | 13.5 | 5.8 | 79 | 8,470 |
| 146 | 6.7 | 12.0 | 2.0 | 1.5 | 0 | 14.0 | 4.9 | 78 | 8,750 |
| 147 | 8.3 | 12.2 | 1.1 | 0.4 | 0 | 13.3 | 6.4 | 69 | 2,750 |
| 148 | 8.1 | 11.9 | 1.0 | 2.5 | 0 | 12.9 | 6.6 | 76 | 6,730 |
| 149 | 8.2 | 12.1 | 0.3 | 1.5 | 0 | 12.4 | 7.9 | 77 | 4,200 |
| 150 | 8.3 | 12.0 | 2.0 | 1.5 | 0 | 14.0 | 4.9 | 73 | 3,300 |
| 151 | 8.2 | 12.2 | 0.3 | 1.5 | 19.2 | 12.5 | 7.9 | 84 | 5,000 |
| 152 | 8.3 | 12.0 | 0.3 | 2.0 | 18.3 | 12.3 | 7.9 | 83 | 4,590 |
| 153 | 8.3 | 12.1 | 0 | 1.4 | 0 | 12.1 | 8.3 | 32 | 600 |
| 154 | 8.3 | 12.1 | 2.5 | 1.4 | 0 | 14.6 | 4.1 | 29 | 800 |

HARD MAGNETIC COMPOSITION, PERMANENT MAGNET POWDER, METHOD FOR PERMANENT MAGNET POWDER, AND BONDED MAGNET

TECHNICAL FIELD

The present invention relates to a hard magnetic compound suitable as a material for permanent magnets used in devices and machines which require magnetic field such as speakers and motors. Additionally, the present invention relates to a magnet powder suitable as a material for permanent magnets, in particular, a material for bonded magnets, and a method for producing the magnet powder.

BACKGROUND ART

Among rare-earth magnets, an R-T-B system rare earth permanent magnet has been used in various electric appliances such as speakers and motors because magnetic properties thereof is excellent, and a main component thereof, Nd, is abundant as a natural resource and relatively inexpensive.

However, in these years, demand for downsizing of electric devices and machines has grown markedly, and accordingly development of new permanent magnet materials has been advanced.

Among such materials are rare earth-iron system magnet materials, having a body-centered tetragonal structure or a $ThMn_{12}$-type structure, reported in, for example, Japanese Patent Laid-Open Nos. 63-273303, 4-241402, 5-65603 and 2000-114017.

Japanese Patent Laid-Open No. 63-273303 discloses a rare earth permanent magnet represented by a formula, $R_xTi_yA_zFe_aCo_b$ (in this formula, R is one of the rare earth elements inclusive of Y; A is one or more of B, C, Al, Si, P, Ga, Ge, Sn, S and N; and x is 12 to 30% by weight, y is 4 to 10% by weight, z is 0.1 to 8% by weight, a is 55 to 85% by weight, and b is 34% or less by weight, respectively). Japanese Patent Laid-Open No. 63-273303 describes that the element A intervenes between atoms to modify the Fe—Fe distances along preferable directions.

Japanese Patent Laid-Open No. 4-241402 discloses a permanent magnet represented by a formula, $R_xM_yA_zFe_{100-x-y-z}$ (in this formula, R is at least one element selected from rare earth elements inclusive of Y; M is at least one element selected from Si, Cr, V, Mo, W, Ti, Zr, Hf and Al; A is at least one element selected from N and C; and x is 4 to 20% by atom, y is 20% or less by atom, and z is 0.001 to 16% by atom), this permanent magnet having as the main phase thereof a phase having a $ThMn_{12}$-type structure. Additionally, Japanese Patent Laid-Open No. 4-241402 discloses that a rare earth-iron system tetragonal compound having a stable $ThMn_{12}$-type structure can be formed by adding the element M (Si, Ti and the like); and Japanese Patent Laid-Open No. 4-241402 discloses that the element A (C, N) is effective for improving the Curie temperature.

Japanese Patent Laid-Open No. 5-65603 discloses an iron-rare earth system permanent magnet material comprising R: 3 to 30% by atom, X: 0.3 to 50% by atom and the balance substantially composed of Fe where R is one element or a combination of two or more elements selected from the group consisting of Y, Th and all the lanthanoid elements, and X is one of or a combination of the elements N (nitrogen), B (boron) and C (carbon), this permanent magnet material having as the main phase thereof a phase having a body-centered tetragonal structure. Japanese Patent Laid-Open No. 5-65603 further proposes that the magnet material includes M: 0.5 to 30% by atom by partially replacing Fe with the element M (one element or a combination of two or more elements selected from the group consisting of Ti, Cr, V, Zr, Nb, Al, Mo, Mn, Hf, Ta, W, Mg, Si, Sn, Ge and Ga). In Japanese Patent Laid-Open No. 5-65603, the element M is regarded as an element having a significant effect in generating the body-centered tetragonal structure.

Additionally, Japanese Patent Laid-Open No. 2000-114017 discloses a permanent magnet material represented by a general formula $(R_{1-u}M_u)(Fe_{1-v-w}Co_vT_w)_xA_y$ (in this formula, R, M, T and A are respectively R: at least one element selected from rare earth elements inclusive of Y, M: at least one element selected from Ti and Nb, T: at least one element selected from Ni, Cu, Sn, V, Ta, Cr, Mo, W and Mn, A: at least one element selected from Si, Ge, Al and Ga; and u, v, w, x and y are respectively such that $0.1 \leqq u \leqq 0.7$, $0 \leqq v \leqq 0.8$, $0 \leqq w \leqq 0.1$, $5 \leqq x \leqq 12$, and $0.1 \leqq y \leqq 1.5$). This permanent magnet material has as the main hard magnetic phase there of a $ThMn_{12}$-type structure. Japanese Patent Laid-Open No. 2000-114017 describes that substitution of the element R with the element M makes it possible to reduce the contents of Si, Ge and the like which are the elements to stabilize the phase having the $ThM_{12}$-type structure (hereinafter referred to as "$ThM_{12}$ phase" as the case may be).

Rare earth permanent magnets are required to have high magnetic properties and on the other hand also to be low in cost. Among the rare earth elements constituting the rare earth permanent magnet, Nd is lower in price than Sm, and hence it is preferable that Nd, inexpensive compared to expensive Sm, makes the main component of the rare earth elements. However, the use of Nd makes the generation of the $ThMn_{12}$ phase difficult, so that the production of the magnet concerned requires a long time heat treatment at a high temperature. More specifically, for example, annealing has been made at 900° C. for 7 days in the above described Japanese Patent Laid-Open No. 5-65603, and only Sm has been used as the rare earth element except for some exceptions in Japanese Patent Laid-Open Nos. 4-241402 and 2000-114017.

In view of the above circumstances, the present invention takes as its object the provision of a hard magnetic compound capable of easily generating the $ThMn_{12}$ phase even when Nd is used as a rare earth element, a permanent magnet powder and the like.

DISCLOSURE OF THE INVENTION

The present inventors have found that even when Nd is used as a rare earth element, a phase having a $ThMn_{12}$-type structure is easily generated by simultaneously adding predetermined amounts of Ti and Si. Additionally, it has also been found that sufficient magnetic properties as a hard magnetic compound for use in permanent magnets are obtained by further adding N and/or C to a compound obtained by simultaneously adding predetermined amounts of Ti and Si.

The present invention has been perfected on the basis of the above findings, and is a hard magnetic compound represented by a general formula $R(Fe_{100-y-w}Co_wTi_y)_xSi_zA_v$ (in the general formula, R is at least one element selected from rare earth elements (here, the rare earth elements signify a concept inclusive of Y) and Nd accounts for 50 mol % or more of R, and A is N and/or C), characterized in that the molar ratios in the general formula are such that x=10 to 12.5, y=(8.3−1.7×z) to 12.3, z=0.1 to 2.3, v=0.1 to 3, and w=0 to 30, and the relation (Fe+Co+Ti+Si)/R>12 is satisfied.

Additionally, the present inventors have found that by partially replacing R with Zr and/or Hf, there can be obtained a hard magnetic compound which exhibits a higher saturation magnetization. In this case, the magnetic compound concerned is represented by a general formula, $R1_{1-u}R2_u(Fe_{100-y-w}Co_wTi_y)_xSi_ZA_v$ (in the general formula, R1 is at least one element selected from rare earth elements (here, the rare earth elements signify a concept inclusive of Y), and 50 mol % or more of R1 is Nd; R2 is Zr and/or Hf; and A is N and/or C), and the composition of the hard magnetic compound may be set so that the molar ratios in the general formula is such that u=0.18 or less, y=4.5 to 12.3, x=11 to 12.8, z=0.1 to 2.3, v=0.1 to 3, and w=0 to 30, and the relation (Fe+Co+Ti+Si)/(R1+R2)>12 is satisfied.

For the purpose of enjoying the advantageous effect of the improvement of the saturation magnetization, the content (u) of the R2 element (Zr and/or Hf) is preferably 0.04 to 0.06.

Even when R is partially substituted with Zr and/or Hf, the hard magnetic compound can be made to be substantially composed of a single phase of a hard magnetic phase, and the hard magnetic phase can be made to be of a $ThMn_{12}$-type structure. It is to be noted that, in the present specification, the partial substitution of R with Zr and/or Hf will be referred to as "Zr(Hf) substitution," as the case may be.

Irrespective as to whether the Zr(Hf) substitution is effected or not, the hard magnetic compound of the present invention can acquire a single phase consisting of a hard magnetic phase even when Nd accounts for 70 mol % or more of R, and the single phase can be made to be a phase having a $ThMn_{12}$-type structure.

In the hard magnetic compound of the present invention, it is preferable that A is N.

Additionally, irrespective as to whether the Zr(Hf) substitution is effected or not, it is preferable that x is 11 to 12.5, z is 0.2 to 2.0, v is 0.5 to 2.5 and w is 10 to 25.

According to the present invention as described above, there can be obtained a hard magnetic compound comprising an R—Ti—Fe—Si-A compound or an R—Ti—Fe—Co—Si-A compound (in the general formula, R is at least one element selected from rare earth elements (here, the rare earth elements signify a concept inclusive of Y) and Nd accounts for 80 mol % or more of R, and A is N and/or C), showing a single phase consisting of a hard magnetic phase, having a saturation magnetization (σs) of 120 emu/g or more, and having an anisotropic magnetic field ($H_A$) of 30 kOe or more. This hard magnetic compound is cost-advantageous since Nd accounts for 80 mol % or more of the above R.

Here, the single phase can be made to be a phase having a $ThMn_{12}$-type structure.

The hard magnetic compound of the present invention can also exhibit excellent magnetic properties such that the anisotropic magnetic field ($H_A$) is 40 kOe or more, and the saturation magnetization (σs) is 130 emu/g or more.

From a viewpoint of lowering the cost for producing a permanent magnet, it is desired that no high-temperature long-time heat treatment is required even when Nd is used. Accordingly, the present inventors investigated an intermetallic compound comprising R (R is at least one element selected from rare earth elements (here, the rare earth elements signify a concept inclusive of Y)) and T (the transition metal elements indispensably including Fe and Ti) which has a composition that the molar ratio of R to T is in the vicinity of 1:12. Consequently, the present inventors have found that a high saturation magnetization and a high anisotropic magnetic field are obtained without applying a high-temperature long-time heat treatment when Si is present as an interstitial element, and moreover, that both of the saturation magnetization and the anisotropic magnetic field are further improved when N is present as an interstitial element.

Additionally, in the above described course of the study, the present inventors have verified that although Si and N are common in that they are interstitial elements, they are different in the interstitial effect which affects the crystal lattice. As will be described later in detail, Si has an effect to shrink the crystal lattice, in particular, the a-axis of the crystal lattice, but on the contrary, N has an effect to isotropically expand the crystal lattice. Consequently, as compared to the hitherto known axial ratio of the c-axis to the a-axis (hereinafter denoted by "c/a") of the crystal lattice of the $ThMn_{12}$-type compound based on ASTM (American Society For Testing and Materials), the c/a value of a new intermetallic compound produced by the present inventors are larger. Incidentally, the c/a value of the $ThMn_{12}$-type compound based on ASTM is 0.558.

The present invention based on the above described findings provides a hard magnetic compound formed of a single phase consisting of an intermetallic compound comprising R and T (R is one or more of the rare earth elements inclusive of Y, and T is the transition metal elements indispensably including Fe and Ti) in a molar ratio of R to T in the vicinity of 1:12, the hard magnetic compound being characterized in that Si and A (A is one or two of N and C) are located as interstitial elements at the interstitial sites in the crystal lattice of the intermetallic compound.

In the hard magnetic compound of the present invention, the molar ratio of R to T is preferably 1:10 to 1:12.5.

The $ThMn_{12}$-type structure as referred to in present invention means a structure which can be identified to be of the $ThMn_{12}$-type structure by X-ray diffraction. However, the structure concerned is different in the c/a value from the $ThMn_{12}$-type compound defined by ASTM. More specifically, the ratio between the lattice constant of the c-axis and the lattice constant of the a-axis in the crystal lattice of said intermetallic compound is represented by c1/a1, and the ratio between the lattice constant of the c-axis and the lattice constant of the a-axis in the crystal lattice of the $ThMn_{12}$-type compound based on ASTM (American Society For Testing and Materials) is represented by c2/a2 (c2/a2=0.558), the relation, c1/a1>c2/a2, holds. In this case, Si anisotropically shrinks the crystal lattice, and A isotropically expands the crystal lattice, so that the relation, c1/a1>c2/a2, can be obtained.

As permanent magnet powders used for bonded magnets and the like, SmCo-magent powder and NdFeB-magnet powder have hitherto been known. From the viewpoint of lowering the cost, it is preferable that Nd, inexpensive compared to expensive Sm, makes the main component of the rare earth elements. For this reason, magnet powders comprising the $Nd_2Fe_{14}B_1$ phase have been widely used. However, more inexpensive magnet powders are demanded.

For the purpose of obtaining such magnet powders, the present inventors have been made various investigations. Consequently, the present inventors have found that by making fine the structure of the hard magnetic compound of the present invention, the hard magnetic compound can exhibit a sufficient coercive force as a permanent magnet powder. More specifically, the permanent magnet powder of the present invention is represented by a general formula $R(Fe_{100-y-w}Co_wTi_y)_xSi_zA_v$ (in this general formula, R is at least one element selected from rare earth elements (the rare earth elements signify a concept inclusive of Y), Nd accounts for 50 mol % or more of R, and A is N and/or C), the permanent magnet powder being characterized by having a composition in which the molar ratios in the general formula are such that x=10 to 12.8, y=(8.3−1.7×z) to 12.3, z=0.1 to 2.3, v=0.1 to 3, w=0 to 30, and a relation, (Fe+Co+Ti+Si)/

R>12, is satisfied, and by being composed of a population of particles having a mean grain size of 200 nm or less.

In the permanent magnet powder of the present invention, it is preferable that each of particles constituting the powder includes as the main phase a phase having a $ThMn_{12}$-type structure, in particular, a single phase consisting of a phase substantially having the $ThMn_{12}$-type structure.

In the permanent magnet powder of the present invention, even when Nd accounts for 70 mol % or more of R, it is possible to obtain a single phase consisting of a phase substantially having the $ThMn_{12}$-type structure. Accordingly, the permanent magnet powder concerned is advantageous for lowering the cost.

The permanent magnet powder of the present invention is, as described above, characterized by having a nanostructure. Such a nanostructure is created by applying a predetermined heat treatment to an amorphous or nanocrystalline powder subjected to quenching and solidification. In a method for producing the permanent magnet powder of the present invention, at the beginning, there is produced a powder subjected to quenching and solidification which has a composition represented by a general formula, $R(Fe_{100-y-w}Co_wTi_y)_xSi_z$ (in this general formula, R is at least one element selected from rare earth elements (the rare earth elements signify a concept inclusive of Y), and Nd accounts for 50 mol % or more of R), and the molar ratios in the general formula are such that x=10 to 12.8, y=(8.3−1.7×z) to 12.3, z=0.1 to 2.3, and w=0 to 30, and the relation (Fe+Co+Ti+Si)/R>12 is satisfied. Then, the powder is subjected to a heat treatment in which the powder is maintained in an inert atmosphere in a temperature range between 600 and 850° C. for 0.5 to 120 hours. Thereafter, the powder subjected to the heat treatment is subjected to nitriding or carbiding.

In the method for producing the permanent magnet powder of the present invention, the powder subjected to quenching and solidification exhibits any structure of an amorphous phase, a mixed phase composed of an amorphous phase and a crystalline phase and a crystalline phase. Of these phases, from a viewpoint of easily controlling the grain size after the successive heat treatment, the mixed phase composed of an amorphous phase and a crystalline phase, in particular, a mixed phase enriched in the crystalline phase is preferable.

In the method for producing the permanent magnet powder of the present invention, the method for quenching and solidification is not particularly specified. However, it is preferable to apply the single casting roll method, since it is more productive, provides reproducibly a desired structure after quenching and solidification and has other advantages. When the single roll casting method is applied, the roll peripheral velocity is preferably set within a range between 10 and 100 m/s. A powder subjected to quenching and solidification within this range can exhibit any structure of an amorphous phase, a mixed phase composed of an amorphous phase and a crystalline phase, and a crystalline phase, although some differences may occur, depending on other conditions such as the composition of a desired alloy, the hole diameter of the nozzle for discharging a melt and the material quality of the roll.

In the method for producing the permanent magnet powder of the present invention, the heat treatment applied to the powder subjected to quenching and solidification serves to crystallize the amorphous phase or to regulate the grain size of the grains constituting the crystalline phase.

By using the permanent magnet powder obtained by the present invention, a bonded magnet can be produced. The bonded magnet includes a permanent magnet powder and a resin for bonding the permanent magnet powder. The crystalline hard magnetic particles, constituting the permanent magnet powder, each are represented by a general formula, $R(Fe_{100-y-w}Co_wTi_y)_xSi_zA_v$ (in the general formula, R is at least one element selected from rare earth elements (here, the rare earth elements signify a concept inclusive of Y) and Nd accounts for 50 mol % or more of R, and A is N and/or C), the crystalline hard magnetic particles being characterized in that the molar ratios in the general formula are such that x=10 to 12.8, y=(8.3−1.7×z) to 12.3, z=0.1 to 2.3, v=0.1 to 3, and w=0 to 30, and the relation (Fe+Co+Ti+Si)/R>12 is satisfied.

From the viewpoint of the magnetic properties, the mean grain size of the hard magnetic particles in the bonded magnet of the present invention is preferably 200 nm or less.

BRIEF DESCRIPTION OF THE DRAWINGS

FIG. 2 is a table showing the compositions, magnetic properties, and phases of the samples obtained in Example 1 (Experimental Example 1);

FIG. 6 is a table showing the compositions, magnetic properties, and phases of the samples obtained in Example 1 (Experimental Example 2);

FIG. 9 is a table showing the compositions, magnetic properties, and phases of the samples obtained in Example 1 (Experimental Example 3);

FIG. 13 is a table showing the compositions, magnetic properties, and phases of the samples obtained in Example 1 (Experimental Example 4);

FIG. 15 is a table showing the compositions, magnetic properties, and phases of the samples obtained in Example 1 (Experimental Example 5);

FIG. 16 is a table showing the compositions, magnetic properties, and phases of the samples obtained in Example 1 (Experimental Example 6);

FIG. 17 is a table showing the compositions, magnetic properties, and phases of the samples obtained in Example 2 (Experimental Example 7);

FIG. 20 is a table showing the compositions, magnetic properties, and phases of the samples obtained in Example 2 (Experimental Example 8);

FIG. 21 is a table showing the compositions, magnetic properties, and phases of the samples obtained in Example 2 (Experimental Example 9);

FIG. 22 is a table showing the compositions, magnetic properties, and phases of the samples obtained in Example 2 (Experimental Example 10);

FIG. 23 is a table showing the compositions, magnetic properties, and phases of the samples obtained in Example 2 (Experimental Example 11);

FIG. 24 is a table showing the compositions, magnetic properties, and phases of the samples obtained in Example 2 (Experimental Example 12);

FIG. 25 is a table showing the compositions, magnetic properties, and phases of the samples obtained in Example 2 (Experimental Example 13);

FIG. 26 is a table showing the compositions, magnetic properties, and phases of the samples obtained in Example 2 (Experimental Example 14);

FIG. 27 is a table showing the compositions, magnetic properties, and phases of the samples obtained in Example 3 (Experimental Example 15);

FIG. 29 is a table showing the compositions, magnetic properties, and phases of the samples obtained in Example 3 (Experimental Example 16);

FIG. 34 is a table showing results of magnetic properties measured after nitriding for Example 4 (Experimental Example 17); and FIG. 35 is a table showing results of magnetic properties measured after nitriding for Example 4 (Experimental Example 18).

BEST MODE FOR CARRYING OUT THE INVENTION

Figure 1:
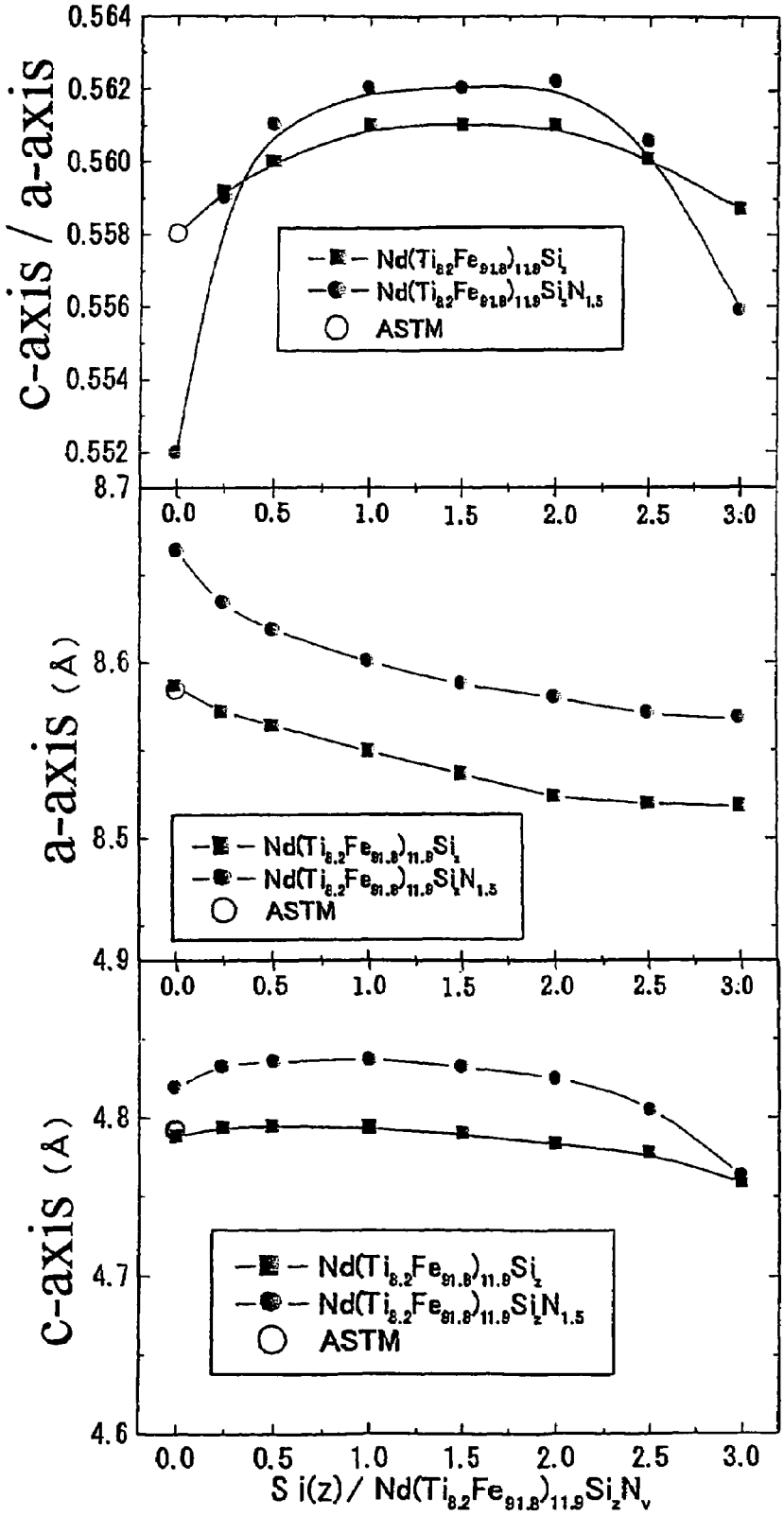
FIG. 1 is a graph showing the relations between the lattice constants (a-axis and c-axis, and c-axis/a-axis) and the Si content (z) in the hard magnetic compounds having the compositions $Nd(Ti_{8.2}Fe_{91.8})_{11.9}Si_z$ and $Nd(Ti_{8.2}Fe_{91.8})_{11.9}Si_zN_{1.5}$.

Now, the examples inclusive of the best mode for the hard magnetic compound, the permanent magnet powder, the method for producing the permanent magnet powder and the bonded magnet of the present invention will be described below.

First, reasons for quantitatively limiting individual elements in the present invention will be described below.

[R (Rare Earth Element or Elements)]

R is an element or a set of elements indispensable for obtaining a high magnetic anisotropy. For the purpose of generating the $ThMn_{12}$ phase as a hard magnetic phase, it is advantageous to use Sm, but in the present invention, Nd is made to account for 50 mol % or more of R, for the purpose of obtaining merits for cost. The present invention makes it possible to easily generate the $ThMn_{12}$ phase even when Nd accounts for 50 mol % or more of R.

It is to be noted that the present invention allows inclusion of rare earth elements other than Nd, in addition to Nd. When such inclusion is the case, it is preferable to include, together with Nd, at least one element selected from Y, La, Ce, Pr and Sm. Of these listed elements, Pr is particularly preferable because Pr exhibits almost the same properties as Nd and accordingly yields the same values as Nd for the magnetic properties.

According to the present invention, even when the proportion of Nd in R is as high as 70 mol % or more, or 90 mol % or more, a structure having as the main phase the $ThMn_{12}$ phase that is a hard magnetic phase can be obtained, and furthermore, a single phase consisting of the $ThMn_{12}$ phase can be obtained. As will be shown in the examples to be described later, according to the present invention, even when R includes only Nd, that is, Nd accounts for 100 mol % of R, a single phase consisting of the $ThMn_{12}$ phase that is a hard magnetic phase can be obtained.

[Si]

When Si is added simultaneously with Ti to R(Nd) and Fe, Si contributes to the stabilization of the $ThMn_{12}$ phase as a hard magnetic phase. In this case, Si is situated at the interstitial sites in the $ThMn_{12}$ phase and has an effect to shrink the crystal lattice. When the Si content is made less than 0.1 (in molar ratio, both here and hereinafter), a phase having the $Mn_2Th_{17}$-type crystal structure (hereinafter referred to as $Mn_2Th_{17}$ phase) tends to segregate, while when the Si content exceeds 2.3, α-Fe tends to segregate. Accordingly, in the present invention, it is recommended that z representing the Si content be set in a range between 0.1 and 2.3. The Si content (z) is preferably 0.2 to 2.0, and further preferably 0.2 to 1.0.

Additionally, as for Si in relation to Fe, Co, Ti and R, it is preferable that Si is contained in such a way that the relation (molar ratio of Fe+molar ratio of Co+molar ratio of Ti+molar ratio of Si)/(molar ratio of R)>12 is satisfied; this point will be described later.

[Ti]

Ti contributes to generation of the $ThMn_{12}$ phase. More specifically, by replacing Fe by a predetermined amount of Ti, the generation of the $ThMn_{12}$ phase is made easy. In order to obtain this effect to a sufficient extent, it is necessary to set the lower limit of the Ti content (y) in relation to the Si content. In other words, as will be shown in the examples to be described later, when the Ti content (y) is less than (8.3−1.7×z (Si content)), α-Fe and the $Mn_2Th_{17}$ phase segregate. On the other hand, the Ti content (y) exceeds 12.3, the decrease of the saturation magnetization becomes remarkable. Accordingly, in the present invention, the Ti content (y) is set between (8.3−1.7×z (Si content)) and 12.3. The Ti content (y) is preferably (8.3−1.7×z (Si content)) to 12, more preferably (8.3−1.7×z (Si content)) to 10, and further preferably (8.3−1.7×z (Si content)) to 9.

Additionally, when the sum (x) of the Fe content and the Ti content is less than 10, both the saturation magnetization and the anisotropic magnetic field are small, while when the sum (x) exceeds 12.5, α-Fe segregates. Accordingly, the sum (x) of the Fe content and the Ti content is set between 10 and 12.5. The sum (x) of the Fe content and the Ti content is preferably 11 to 12.5.

[A (N (Nitrogen) and/or C (Carbon))]

A is an element effective in improving the magnetic properties in such a way that A is situated at the interstitial sites in the $ThMn_{12}$ phase and thereby expands the lattice of the $ThMn_{12}$ phase. However, when the A content (v) exceeds 3.0, the segregation of α-Fe is observed, while the A content (v) is less than 0.1, no sufficient improvement effects of the magnetic properties can be obtained. Accordingly, the A content (v) is set between 0.1 and 3.0.

The A content (v) is preferably 0.3 to 2.5, and further preferably 1.0 to 2.5.

[Fe, Fe—Co]

In the hard magnetic compound according to the present invention, Fe substantially accounts for the part of the composition that does not include the above described elements. However, it is effective to substitute a part of Fe with Co. As will be described in the example to be described later, addition of Co increases the saturation magnetization ($\sigma_s$) and the anisotropic magnetic field ($H_A$). Addition of Co is carried out preferably with an addition amount of 30 or less in terms of molar ratio, and more preferably with a range between 5 and 20. The addition of Co is not indispensable.

[(Molar ratio of Fe+molar ratio of Co+molar ratio of Ti+molar ratio of Si)/(molar ratio of R)>12]

The respective contents of Fe, Co, Ti and Si are as described above, but it is important to satisfy the condition that (Fe+Co+Ti+Si)/R>12 for the purpose of making the hard magnetic compound of the present invention be of the single phase consisting of the $ThMn_{12}$ structure. As will be shown in the examples to be described later, the saturation magnetization is low when the above described condition is not satisfied.

[Zr, Hf]

In the above, the composition of the hard magnetic compound according to the present invention has been described.

The hard magnetic compound of the present invention may further contain Zr and/or Hf. Inclusion of Zr and/or Hf is effective in improving the magnetic properties, in particular, the saturation magnetization.

R is partially substituted with Zr and/or Hf in the above described general formula. When u representing the substitution content of Zr and/or Hf exceeds 0.18, the saturation magnetization becomes lower than when u is null. Accordingly, when R is partially substituted with Zr and/or Hf, u is set at 0.18 or less (exclusive of 0). The value of u is preferably 0.01 to 0.15, and further preferably 0.04 to 0.06.

Here is shown the Ti content (y) in the case where the Zr(Hf) substitution is carried out.

When the Zr(Hf) substitution is carried out, the Ti content (y) is set between 4.5 and 12.3. In this case, the Ti content (y) is set preferably between 5 and 12, more preferably between 6 and 10, and further preferably between 7 and 9. In this connection, the sum (x) of the Fe content, the Co content and the Ti content is set between 11 and 12.8, and preferably between 11.5 and 12.5.

The hard magnetic compound according to the present invention can be obtained by the production methods well known in the art.

As for the interstitial element N, a material originally containing N may be used. However, it is preferable that after a compound containing elements other than N has been produced, N is made to interstitially enter into the compound by a treatment (nitriding) in a gas or liquid containing N. As the gas capable of making N interstitially enter into the compound, there can be used $N_2$ gas, a ($N_2$+$H_2$) mixed gas, $NH_3$ gas, and a mixed gas composed of these gases. The temperature for the nitriding may be set between 200 and 1000° C., and preferably between 350 and 700° C. The nitriding time may be selected appropriately to fall within a range between 0.2 and 200 hours.

As for the treatment (carbiding) for making C enter into the compound, the relevant description is the same as for the case of N. In other words, a material originally containing C may be used; and after a compound containing elements other than C has been produced, the compound may be heat treated in a gas or liquid containing C. Alternatively, by heat treating the compound with a solid material containing C, C may be made to interstitially enter into the compound. Examples of the gas capable of making C interstitially enter into the compound include $CH_4$, and $C_2H_6$ and the like. As a solid material containing C, carbon black may be used. In the carbiding using these materials, the treatment conditions may be appropriately set within a temperature range and a treatment time similar to those for the nitriding.

<Crystal Structure>

Next, the crystal structure of the hard magnetic compound according to the present invention will be described below.

The hard magnetic compound of the present invention includes R (R is at least one element selected from rare earth elements (here, the rare earth elements signify a concept inclusive of Y)) and T (the transition metal elements indispensably including Fe and Ti), and is constituted of an intermetallic compound having a composition falling in the vicinity of an R to T molar ratio of 1:12. At the interstitial sites in the crystal of the intermetallic compound, Si is situated as an interstitial element. Additionally, N is also situated as an interstitial element in this crystal lattice.

As described above, both Si and N are situated at the interstitial sites in the crystal to improve the magnetic properties. It is to be noted that Si shrinks the crystal lattice, while N expands the crystal lattice, Si and N being different in effect in such a way. Now, this point will be mentioned below.

FIG. 1 is graphs showing the relations between the lattice constants (c-axis and a-axis, and c-axis/a-axis) and the Si content (z) in the hard magnetic compounds having the compositions $Nd(Ti_{8.2}Fe_{91.8})_{11.9}Si_z$ and $Nd(Ti_{8.2}Fe_{91.8})_{11.9}Si_zN_{1.5}$. The hard magnetic compounds shown in FIG. 1 are the compounds disclosed in the examples to be described later.

In FIG. 1, no large variations of the lattice constants due to addition of Si are found for the c-axis. However, for the a-axis, it can be seen that addition of Si remarkably reduces the lattice constant. In other words, Si has a feature such that Si is situated interstitially in the crystal to anisotropically shrink the crystal lattice.

Next, in FIG. 1, it can be seen that addition of N enlarges the lattice constants for both the c-axis and the a-axis. In other words, N is situated in the interstitial sites in the crystal and isotropically expands the crystal lattice. As described above, by shrinking or expanding the crystal lattice, the saturation magnetization, the Curie temperature and the anisotropic magnetic field are improved. As can also be seen from FIG. 1, the effect of anisotropically shrinking the crystal lattice, due to Si, is not altered even by addition of N. Additionally, the presence of Si shrinks the crystal lattice, and coexistence of N and Si makes remarkable the effect of Si in improving the anisotropy and makes easier the generation of a single phase.

In FIG. 1, the plots carrying the symbol "ASTM" refer to the lattice constant of the c-axis, the lattice constant of the a-axis and the lattice constant of the c-axis/the lattice constant of the a-axis for the $ThMn_{12}$-type compound described in ASTM. It can be seen that the lattice constants for a composition represented by $Nd(Ti_{8.2}Fe_{91.8})_{11.9}Si_z$ with z equal to zero coincide with the lattice constants of the $ThMn_{12}$-type compound described in ASTM.

The presence of Si at the interstitial sites in a crystal can be verified as follows. An investigation based on the X-ray diffraction method of the composition represented by $Nd(Ti_{8.2}Fe_{91.8})_{11.9}Si_z$ described above with z equal to zero, namely, a compound containing no Si and a compound containing Si was carried out to reveal that no variation of the fundamental shapes of the obtained diffraction peaks was found between these compounds. Moreover, no peaks of Si or no peaks of the compounds between the constituent elements of the above described compound and Si, and no peaks of α-Fe were identified. Furthermore, with increasing content of Si, the lattice constant of the a-axis was continuously decreased. From these findings, it can be verified that Si is situated at the interstitial sites in the crystal.

Additionally, in the present invention, N atoms are situated at the interstitial sites in the crystal to expand both the c-axis and the a-axis with almost the same proportions. On the contrary, Si is situated at the interstitial sites in the crystal to shrink only the a-axis, so that it is inferred that Si is situated at some particular sites in the crystal lattice. At present, such sites of Si cannot be identified, but the X-ray diffraction pattern ascribable to the $ThMn_{12}$-type compound is shown, so that it is understood that Si is situated at some particular interstitial sites in the crystal.

Although the hard magnetic compound of the present invention exhibits the lattice constants different from those of the $ThMn_{12}$-type compound described in ASTM, the hard magnetic compound concerned exhibits, in X-ray diffraction, a diffraction pattern identifiable as that of the $ThMn_{12}$-type compound. Consequently, the hard magnetic compound of the present invention is identified as a $ThMn_{12}$-type compound. In the hard magnetic compound of the present invention, it is preferable that the hard magnetic phase is made to have a $ThMn_{12}$-type crystal structure. In particular, from the viewpoint of the magnetic properties, it is preferable that the hard magnetic phase is made to be substantially constituted of a single phase consisting of a $ThMn_{12}$-type crystal structure.

In the above, the hard magnetic compound of the present invention has been described. Although the hard magnetic compound is suitable as a material for magnets, the present inventors have found that the hard magnetic compound concerned can exhibit a sufficient coercive force as a permanent magnet powder by making fine structure of the hard magnetic compound. Now, the permanent magnet powder and the production method thereof according to the present invention will be described below in detail.

[Structure of the Permanent Magnet Powder]

First, the structure of the permanent magnet powder of the present invention will be described.

The permanent magnet powder of the present invention is so fine that the mean grain size thereof is 200 nm or less, preferably 100 nm or less, and more preferably 80 nm or less. With such a nanostructure, the present invention can develop the coercive force required for a permanent magnet powder. The method for obtaining such a nanostructure in the present invention will be described later. The grain size is a value derived as follows: a quenched alloy subjected to a heat treatment was observed by TEM to identify individual grains and the areas of the individual grains were obtained by image processing, and then the diameter of a circle having the same area as that of each of the grains was taken as the grain size of the grain concerned. The mean grain size was obtained by measuring the individual sizes of about 100 grains for each sample and taking the mean value thereof.

The permanent magnet powder of the present invention having a nanostructure is made to have the $ThMn_{12}$ phase as the main phase, and more preferably to be a single phase consisting of the $ThMn_{12}$ phase. The judgment as to whether the single phase consisting of the $ThMn_{12}$ phase is actualized or not is made according to the criteria shown in the example to be described later.

[Method for Producing the Permanent Magnet Powder]

Next, a method for producing the permanent magnet powder of the present invention will be described below.

The permanent magnet powder of the present invention is characterized, as described above, by having a nanostructure, and several methods can be applied for obtaining such a nanostructure. For example, there can be cited a method using melt spinning, a method using mechanical grinding or mechanical alloying, and a method using HDDR (Hydrogenation-Decomposition-Desorption-Recombination). Now, the production method using melt spun will be described below.

The production method using melt spun includes three main steps, namely, a step for melt spinning, a step for heat treatment and a step for nitriding. Each of these steps will be described below sequentially.

<Step for Melt Spinning>

In the step for melt spinning, the melt is obtained by melting the raw metals blended so as to have the above described composition, and then the melt is subjected to quenching and solidification. Specific examples of the solidification method include the single roll casting method, the twin roll casting method, the centrifugal quenching method and the gas atomizing method. Of these methods, it is preferable to use the single roll casting method. In the single roll casting method, melted alloy is discharged from a nozzle and is made to collide with the peripheral surface of a cooling roll so as to be quenched, and thus a quenched strip-like or flake-like alloy is obtained. The single roll casting method is higher in mass productivity and more satisfactory in reproducibility of quenching conditions compared with other melt spun.

The quenched and solidified alloy exhibits any structure form of an amorphous single phase, a mixed phase composed of an amorphous phase and a crystalline phase, and a single phase composed of a crystalline phase, depending on the composition of the alloy, and the peripheral velocity of the cooling roll. The amorphous phase is nanocrystallized by the heat treatment to be carried out later. A basis for prediction is such that with increasing peripheral velocity of the cooling roll, the proportion of the amorphous phase is increased.

When the peripheral velocity of the cooling roll becomes faster, the obtained quenched alloy becomes thinner, so that a more uniform quenched alloy can be obtained. It is most desirable for the present invention that the alloy, after quenching and solidification, has a desirable structure, but it is not easy to realize. On the other hand, it is needless to say possible to nanocrystallize a single phase consisting of an amorphous phase by a heat treatment after the single phase concerned has been obtained. However, there is a fear that abnormal grain growth may be caused by precedently formed nuclei lead to generation of coarse grains. Accordingly, a preferable mode for the present invention is such that there is obtained a solidified structure which is rich in a nanocrystalline phase and the balance is constituted of an amorphous phase.

For that purpose, the peripheral velocity of the cooling roll is set usually between 10 and 100 m/s, preferably between 15 and 75 m/s, and further preferably between 25 and 75 m/s. When the peripheral velocity of the cooling roll is set to be less than 10 m/s, grains become coarse and the desired nanostructure can hardly be obtained, while when the peripheral velocity of the cooling roll exceeds 100 m/s, the close contact between the melted alloy and the peripheral surface of the cooling roll is degraded to prevent effective heat transfer therebetween. The equipment cost is also thereby raised. It is preferable that the step for melt spinning is conducted in a nonoxidative atmosphere such as an atmosphere of Ar gas or $N_2$ gas.

<Step for Heat Treatment>

The quenched alloy obtained by the step for melt spinning is successively subjected to a heat treatment. The heat treatment generates a nanocrystal having the grain size required in the present invention when the quenched alloy shows a single phase composed of an amorphous phase. Additionally, when the quenched alloy shows a mixed phase composed of an amorphous phase and a crystalline phase, the heat treatment nanocrystallizes the amorphous phase, and additionally, controls the grains so as to have the grain size required in the present invention. Moreover, when the quenched alloy shows a single phase consisting of a crystalline phase, the heat treatment controls the grains thereof so as to have the grain size required in the present invention. Accordingly, as long as the nanostructure required by the permanent magnet powder of the present invention is not obtained as the state of the quenched alloy, it is necessary to apply this heat treatment.

The treatment temperature in the heat treatment is 600 to 850° C., preferably 650 to 800° C., and further preferably 670 to 750° C. The treatment time depends on the treatment temperature, and usually set at approximately 0.5 to 120 hours. It is preferable that the heat treatment is conducted in a nonoxidative atmosphere such as an atmosphere of Ar gas or He gas, or a vacuum.

<Step for Nitriding>

After the heat treatment, the quenched alloy is subjected to nitriding. As for N that is an interstitial element, a raw material originally containing N may be used, but it is preferable that after a compound containing elements other than N has been produced, N is made to interstitially enter by treatment (nitriding) in a gas containing N or a liquid containing N. As a gas capable of making N interstitially enter, there can be used $N_2$ gas, a ($N_2$+$H_2$) mixed gas, $NH_3$ gas and mixed gases consisting of these gases. It is preferable that the treatment is conducted with these gases as high-pressure gases for the purpose of accelerating the nitriding.

The temperature for the nitriding may be set between 200 and 450° C., and preferably between 350 and 420° C., the nitriding time may be appropriately selected within a range between 0.2 and 200 hours. As for the treatment (carbiding) for making C enter interstitially, the procedures concerned are similar to those in the case of N, and a raw material originally containing C may be used, and after a compound containing elements other than C has been produced, the compound may be heat-treated in a gas or liquid containing C. Alternatively, the compound may be heat-treated together with a solid material containing C, to allow C penetrate therein interstitially. Examples of a gas capable of making C interstitially enter include $CH_4$, $C_2H_6$ and the like. As a solid material containing C, carbon black may be used. In the carbiding with these materials, within a temperature range and a range of treatment time, similar to those for nitriding, the conditions can be set appropriately.

The fundamental steps for obtaining the permanent magnet powder of the present invention are as described above, and the alloy obtained by melt spun may be milled before the step for heat treatment, before the step for nitriding, or after the step for nitriding. This is because the alloy obtained by melt spun usually does not meet the size required for the permanent magnet powder for use in bonded magnets. The milling is conducted in an inert gas such as Ar and $N_2$.

No particular constraint is imposed on the mean particle size of the permanent magnet powder; however, the particle size is preferably such that in a particular particle, sections largely different from each other in crystallinity are found as scarcely as possible, and such that the particle size makes the powder usable as a permanent magnet powder. More specifically, when applied to bonded magnets, it is usually preferable that the mean particle size is 10 μm or more; however, for the purpose of ensuring sufficient resistance to oxidation, the mean particle size is set at preferably 30 μm or more, more preferably 50 μm or more, and furthermore preferably 70 μm or more. The mean particle size of these orders permits making high density bonded magnets. On the other hand, the upper limit of the mean particle size is preferably 500 μm, and more preferably 250 μm. It is to be noted that the mean particle size as referred to here can be specified by the median diameter D50. D50 is a particle size at which the sum of the masses of the particles reaches 50% of the total mass of the whole particles when the masses of the particles are summed starting from the smallest size particles, namely, the cumulative frequency in the particle size distribution graph.

The permanent magnet powder obtained as described above can be applied to bonded magnets. Bonded magnets are produced by bonding the particles constituting the permanent magnet powder with a binder. Bonded magnets are classified into several types according to the production methods thereof. Examples of the types include a compression bonded magnet based on the press molding and an injection bonded magnet based on the injection molding. As binders, various resins are preferably used, but when metal binders are used, metal bonded magnets are made. No particular constraint is imposed on the types of resin binders, and the resin binders may be appropriately selected from various thermosetting resins and various thermoplastic resins such as epoxy resin and nylon. No particular constraint is also imposed on the types of metal binders. Additionally, no particular constraints are imposed on the various conditions including the content ratio of a binder to the permanent magnet powder and the pressure in molding, and the conditions may be appropriately set in the typical ranges concerned. It is to be noted that for the purpose of avoiding coarsening the grains, it is preferable to avoid such methods that necessitate high temperature heat treatment.

In the above, the examples in which nanostructure is obtained by use of melt spun has been described. However, the present invention is not limited to this method. As another method, there can be cited a method using mechanical grinding. This method includes three main steps, namely, a mechanical grinding step, a heat treatment step and a nitriding step. Descriptions on the heat treatment step and the nitriding step will be omitted because these steps are the same as those in the above described method using melt spun.

Mechanical grinding can convert a material having a crystalline structure to a material consisting of an amorphous phase by successively applying mechanical impact to alloy particles milled to a predetermined particle size. The mechanical impact may be exerted by use of apparatuses known as milling machines such as a ball mill, a shaker mill and a vibration mill. By treating alloy particles with these milling machines, the structure of the particles can be made amorphous.

Alloy particles may be produced by use of conventional methods. For example, after an ingot having a predetermined compound has been prepared, alloy particles can be obtained by milling the ingot. Alternatively, a strip-like material or a thin flake-like material, obtained by melt spun, may be subjected to mechanical grinding. In this connection, needless to say, if the belt-like or flake-like material is amorphous originally, no such grinding is needed.

An alloy powder made amorphous by applying mechanical grinding are successively subjected to the heat treatment step and the nitriding step to be able to yield the permanent magnet powder of the present invention. Additionally, by use of the permanent magnet powder, the bonded magnet of the present invention can be obtained.

As a method for obtaining a nanostructure, there is cited heat treatment (HDDR: Hydrogenation-Decomposition-Desorption-Recombination) in which a target material is maintained at a high temperature in an atmosphere of hydrogen, and then hydrogen is removed. In the present invention, a nanostructure can be obtained also by applying this HDDR treatment. The permanent magnet powder of the present invention can be obtained by successively applying the heat treatment step and the nitriding step to a powder having been subjected to the HDDR treatment. Additionally, by use of the permanent magnet powder, the bonded magnet of the present invention can be obtained.

EXAMPLES

Next, the present invention will be described below in more detail with reference to specific examples.

Example 1

The experimental results (experimental examples 1 to 6) supporting the above described reasons for limiting the range of the composition will be described as Example 1. As described above, although the hard magnetic compound of the present invention exhibits the lattice constants different from those of the $ThMn_{12}$-type compound described in ASTM, the hard magnetic compound concerned exhibits a diffraction pattern in X-ray diffraction identifiable as that of the $ThMn_{12}$-type compound.

Experimental Example 1

At the beginning, description will be made on the experimental results (Experimental Example 1) for the z value (Si content) dependences of the phase state and the magnetic properties.

Figure 3A:
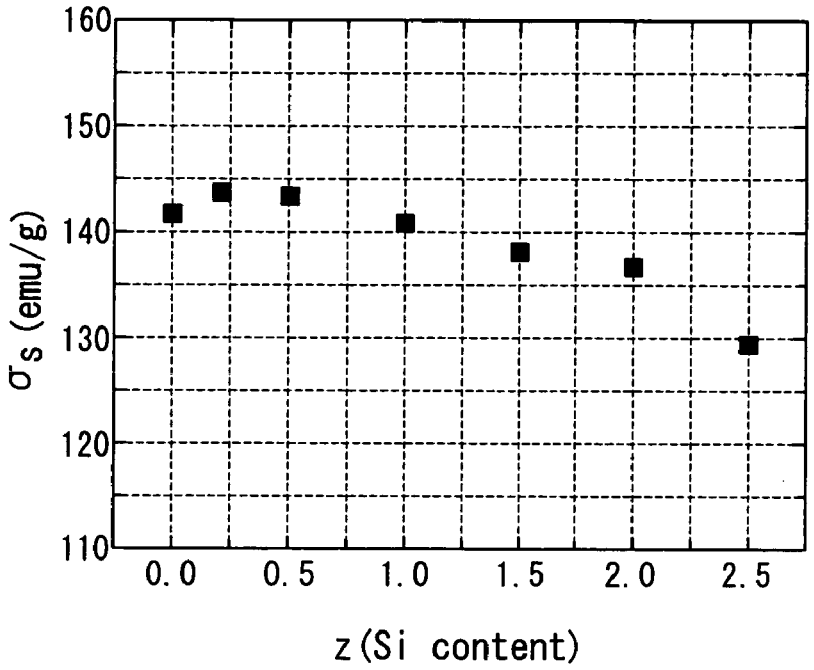
FIG. 3A is a graph showing the relation between the Si content and the saturation magnetization (σs)
Figure 3B:
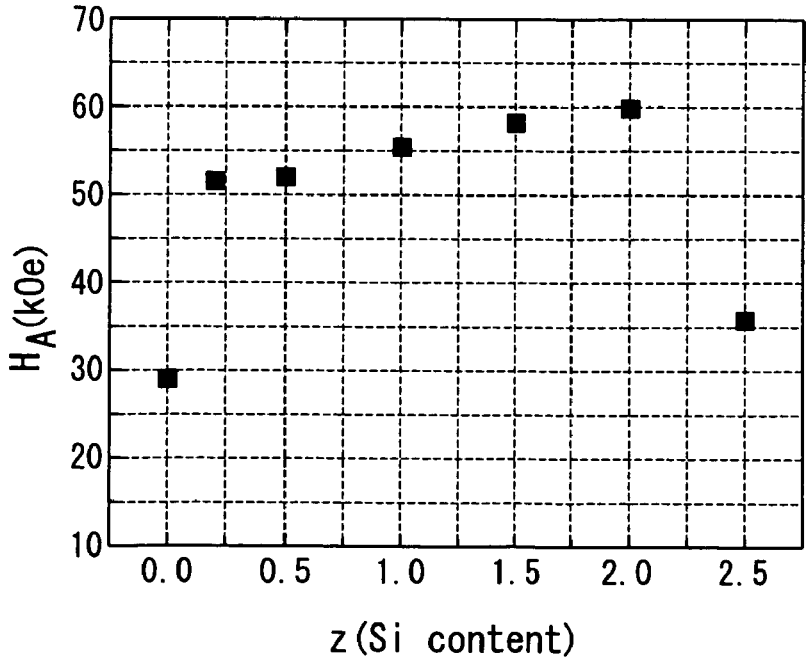
FIG. 3B is a graph showing the relation between the Si content and the anisotropic magnetic field ($H_A$)

High purity Nd, Fe, Ti and Si metals were used as raw materials, and each sample was prepared by means of the arc melting method in an Ar atmosphere in such a way that its alloy composition may be represented by $Nd—(Ti_{8.3}Fe_{91.7})_{12}—Si_z$. Successively, the alloy was milled with a stamp mill and passed through a sieve with opening of 38 μm, and then subjected to a heat treatment (nitriding) in which the alloy was maintained at 430 to 520° C. for 100 hours in a nitrogen atmosphere. After the heat treatment, each of the samples was subjected to a chemical composition analysis and an identification of the formed phases, and measurements of the saturation magnetization (σs) and the anisotropic magnetic field ($H_A$) The results obtained are shown in FIGS. 2 and 3.

The identification of the formed phases was carried out on the basis of the X-ray diffraction method and the measurement of the thermomagnetic curve. For the X-ray diffraction, a Cu tube was used and measurement was made with a power output of 15 kW, to verify whether the peaks of the $ThMn_{12}$ phase and the peaks of the other phases were observed. However, because the peaks of the $Mn_2Th_{17}$ phase almost coincide with the peaks of the $ThMn_{12}$ phase, the verification was difficult only with the X-ray diffraction method. Accordingly, for the identification of the formed phases, the thermomagnetic curves were also used. The thermomagnetic curves were measured by applying a magnetic field of 2 kOe to verify whether the Tc (Curie temperature) for each of the phases other than the $ThMn_{12}$ phase was observed. It is to be noted that in the present invention, "a single phase consisting of the $ThMn_{12}$ phase" means that no peaks other than those of the $ThMn_{12}$ phase are observed by the above described X-ray diffraction method, no Tc other than that of the $ThMn_{12}$ phase was observed by the above described measurement of the thermomagnetic curves, and the remanent magnetization found in the region above the Tc concerned is 0.05 or less; it does not matter if undetectable amounts of unavoidable impurities, unreacted substances and the like are contained. For example, in the arc melting, sometimes the thermal uniformity during dissolving was insufficient to yield traces of residual unreacted phases (for example, Nd, α-Fe and the like), and sometimes Cu and the like from the sample holder were contained as unavoidable impurities, but the unavoidable impurities were not taken into consideration as long as these impurities were not detected by the X-ray diffraction and thermomagnetic curve measurements. Specific examples for the identification of the formed phases will be described on the basis of FIGS. 4 and 5.

Figure 4:
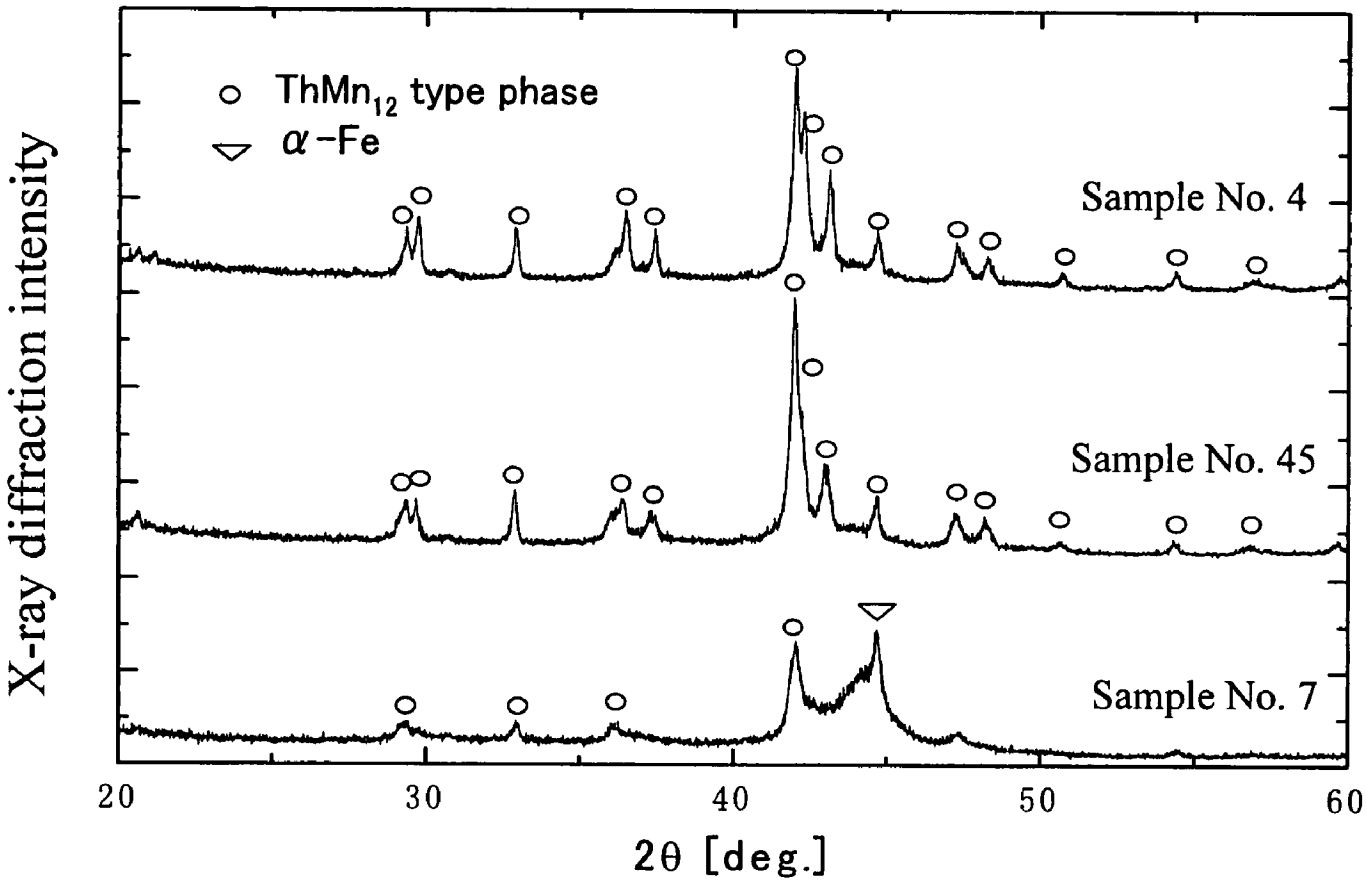
FIG. 4 is a chart showing the results of X-ray diffraction for Samples Nos. 4, 7 and 45.

FIG. 4 is a chart showing the results of X-ray diffraction for Samples Nos. 4 and 7 and Sample No. 45 to be described later. As shown in FIG. 4, for Samples Nos. 4 and 45, only the peaks indicating the $ThMn_{12}$ phase were observed. However, for Sample No. 7, a peak ascribable to α-Fe was able to be identified. As described above, the peaks of the $Mn_2Th_{17}$ phase overlapped with the peaks of the $ThMn_{12}$ phase, so that the former were unable to be discerned from the latter on the graph concerned.

Figure 5:
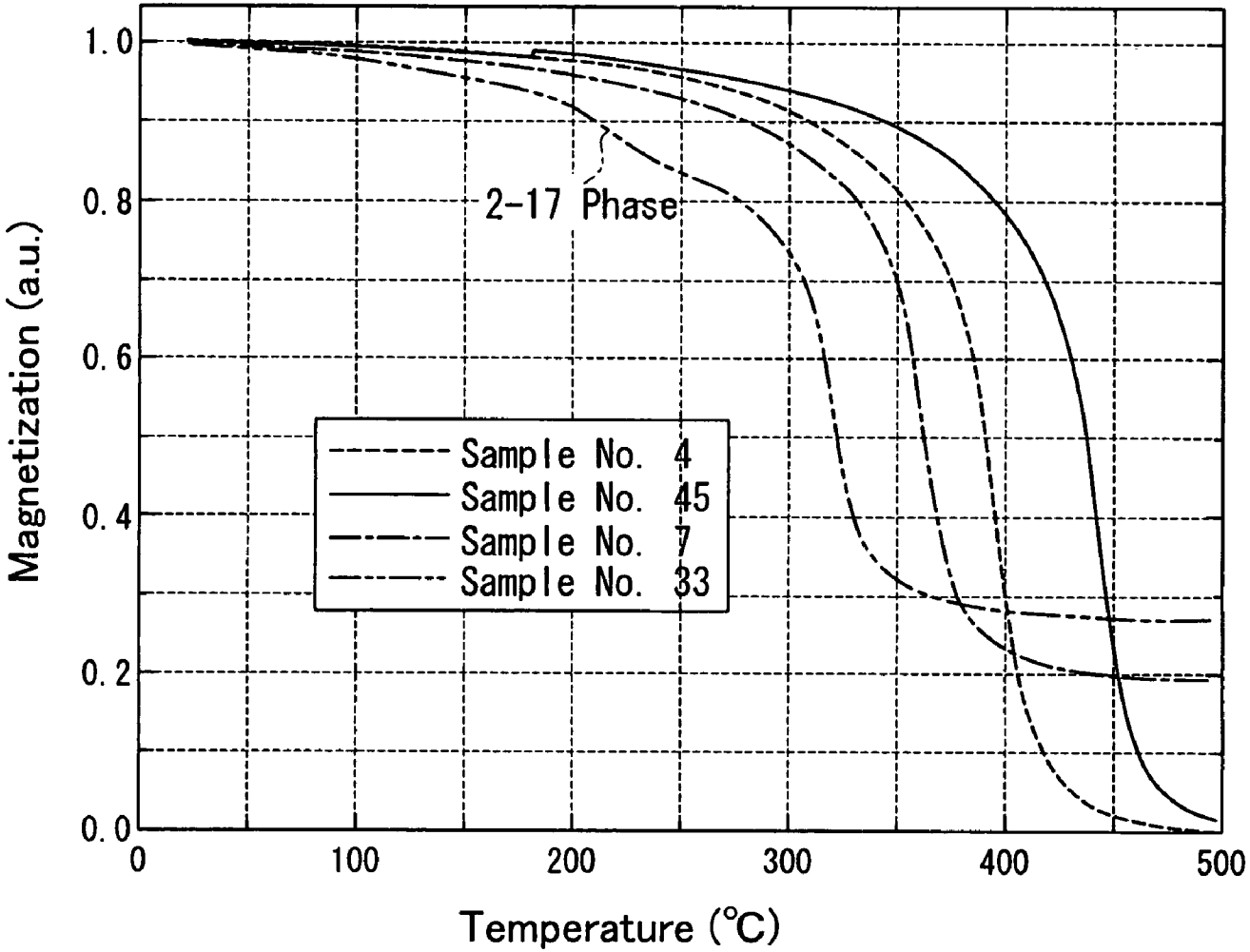
FIG. 5 is a graph showing the thermomagnetic curves for Samples Nos. 4, 7, 33 and 45.

FIG. 5 shows the thermomagnetic curves for Samples Nos. 4 and 7 and Samples Nos. 33 and 45 to be described later. The Tc of the $ThMn_{12}$ phase was found in the vicinity of 400° C. As shown in FIG. 5, the Tc of the $Mn_2Th_{17}$ phase (2-17 phase) was identified on the lower temperature side of the Tc of the $ThMn_{12}$ phase (Sample No. 33). Here, when the Tc other than the Tc of the $ThMn_{12}$ phase was not identified, and the remanent magnetization on the temperature side higher than this Tc was 0.05 or less, the sample was recognized to be of single phase. More specifically, in each of Samples Nos. 4 and 45, the Tc other than the Tc of the $ThMn_{12}$ phase was not identified, and the remanent magnetization on the temperature side higher than this Tc was 0.05 or less, and consequently, Samples Nos. 4 and 45 each were identified to be of the single phase consisting of the $ThMn_{12}$ phase. In Sample No. 7, the Tc other than the Tc of the $ThMn_{12}$ phase was not identified, but it was identified that α-Fe segregated in addition to the $ThMn_{12}$ phase on the basis of the fact that the remanent magnetization exceeded 0.05 on the temperature side higher than this Tc and FIG. 4. Moreover, in Sample No. 33, the Tc of the $Mn_2Th_{17}$ phase was identified, and the remanent magnetization on the temperature side higher than the Tc of the $ThMn_{12}$ phase exceeded 0.05, and consequently, it was identified that the $Mn_2Th_{17}$ phase and α-Fe segregated in addition to the $ThMn_{12}$ phase.

As described above, in the present invention, when no phase other than the $ThMn_{12}$ phase is identified both in FIG. 4 (X-ray diffraction) and FIG. 5 (thermomagnetic curve), the phase is defined to be the single phase consisting of the $ThMn_{12}$ phase.

The saturation magnetization (σs) and the anisotropic magnetic field ($H_A$) were derived from the magnetization curves for the direction of the axis of easy magnetization and the magnetization curves for the direction of the axis of hard magnetization measured by use of a VSM (Vibrating Sample Magnetometer) at a maximum applied magnetic field of 20 kOe. For the convenience of the measurement, the maximum magnetization value found on the magnetization curve for the direction of the axis of easy magnetization was taken as the saturation magnetization (σs). The anisotropic magnetic field ($H_A$) was defined as the magnetic field value for which the line tangent, at 10 kOe, to the magnetization curve for the direction of the axis of hard magnetization intersected the saturation magnetization (σs) value.

As shown in FIGS. 2 and 3, in Sample No. 6 having no added Si, the $Mn_2Th_{17}$ phase (hereinafter referred to as the 2-17 phase) and α-Fe were present in addition to the $ThMn_{12}$ phase (hereinafter referred to as the 1-12 phase), and the anisotropic magnetic field ($H_A$) was particularly low. On the contrary, it was found that in each of Samples Nos. 1 to 5 having added Si, the phase was of the single phase composed of the 1-12 phase, and the 1-12 phase was stabilized. These compounds each showing the single phase composed of the 1-12 phase can acquire a saturation magnetization (σs) of 130 emu/g or more and an anisotropic magnetic field ($H_A$) of 50 kOe or more. However, in Sample No. 7 having a Si content of 2.5, α-Fe segregated and the properties were lowered. In Sample No. 8 having a (Fe+Ti) content of less than 10 and a Si content of 2.5, both of the saturation magnetization (σs) and the anisotropic magnetic field ($H_A$) were remarkably decreased. If soft magnetic α-Fe is present, the portion containing such α-Fe generates a reverse magnetic domain at a low magnetic field (demagnetizing field). Accordingly, the coercive force becomes small as a result of easily promoting the inversion of the magnetic domains in the hard magnetic phase component, and accordingly the presence of α-Fe is not desirable for permanent magnets required to have coercive force.

Within the scope of Samples Nos. 1 to 5, the anisotropic magnetic field ($H_A$) tends to be increased with increasing Si content, whereas the saturation magnetization (σs) tends to be increased with decreasing Si content.

Experimental Example 2

Figure 7A:
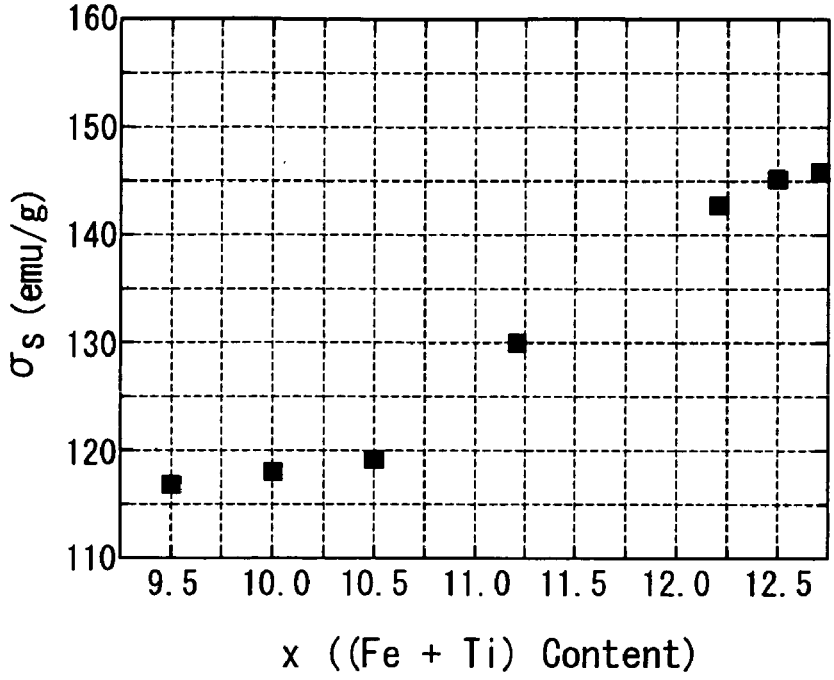
FIG. 7A is a graph showing the relation between the (Fe+Ti) content and the saturation magnetization (σs)
Figure 8A:
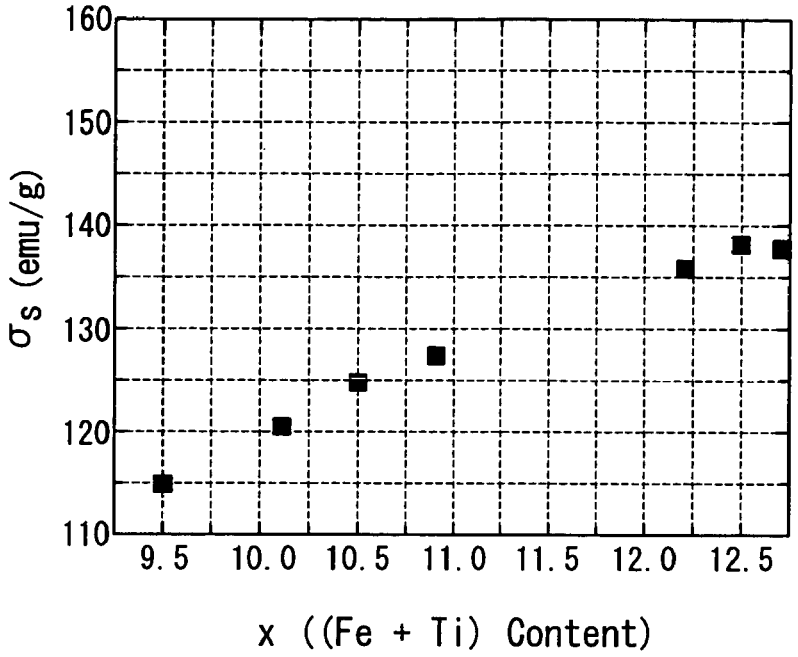
FIG. 8A is a graph showing the relation between the (Fe+Ti) content and the saturation magnetization (σs)

In the same manner as in Experimental Example 1, each sample was prepared in such a way that the composition concerned may be represented by $Nd—(Ti_{8.3}Fe_{91.7})_x—Si_z—N_{1.5}$. The samples obtained each were analyzed for chemical composition, identified for phases, and measured for saturation magnetization (σs) and anisotropic magnetic field ($H_A$). The composition, the magnetic properties and the phases of each of the samples obtained in Experimental Example 2 are shown in FIG. 6. The results of measurement of the saturation magnetization (σs) and the anisotropic magnetic field ($H_A$) for the Samples Nos. 9 to 11 and 17 to 20 are shown in FIGS. 7A and B, respectively. Similarly, the results of the measurement of the saturation magnetization (σs) and the anisotropic magnetic field ($H_A$) for the Samples Nos. 12 to 16, 21 and 22 are shown in FIGS. 8A and B, respectively. It is to be noted that Experimental Example 2 is an experiment carried out for the purpose of investigating the effects of the x (Fe content+Ti content) and (x+z) (Fe content+Ti content+Si content) on the phases, the saturation magnetization (σs) and the anisotropic magnetic field ($H_A$).

Figure 7B:
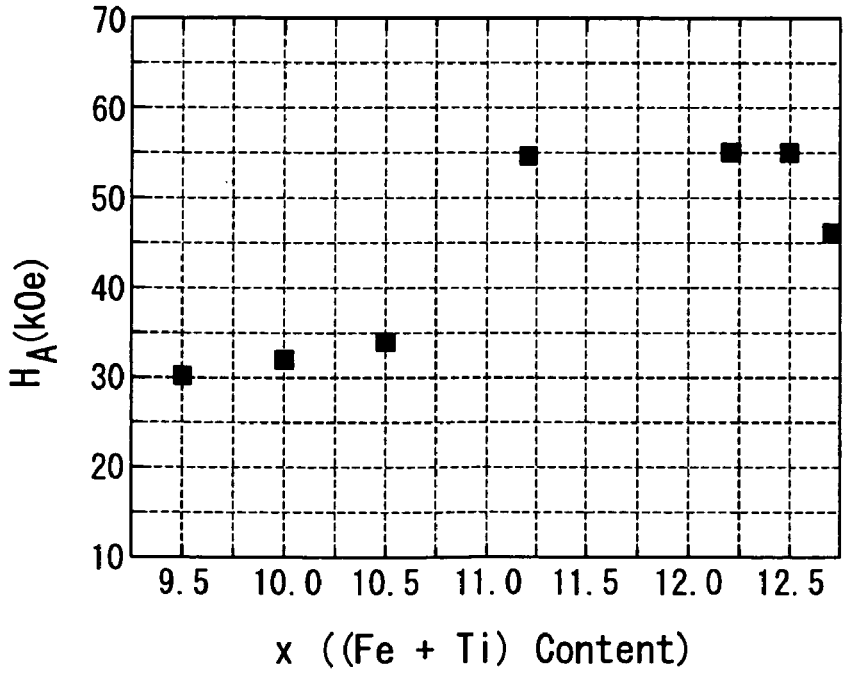
FIG. 7B is a graph showing the relation between the (Fe+Ti) content and the anisotropic magnetic field ($H_A$)
Figure 8B:
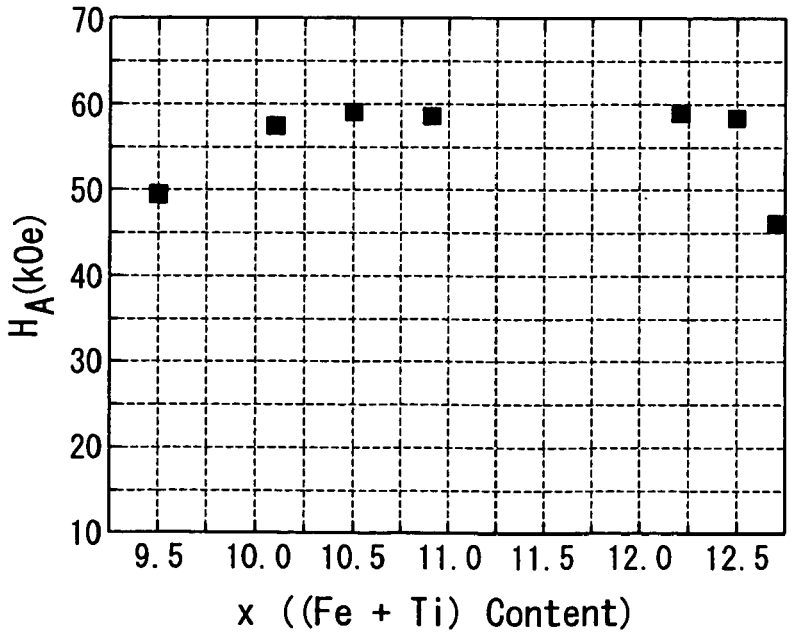
FIG. 8B is a graph showing the relation between the (Fe+Ti) content and the anisotropic magnetic field ($H_A$)

As shown in FIGS. 6 to 8, when x is less than 10 (Samples Nos. 17 and 21), the saturation magnetization (σs) is less than 120 emu/g, and in Sample No. 17 having such a low z (Si content) as 1.1, the anisotropic magnetic field ($H_A$) is as low as about 30. On the contrary, when the x exceeds 12.5 (Samples Nos. 20 and 22), α-Fe comes to segregate. Even when x falls within a range between 10 and 12.5, the saturation magnetization (σs) is as low as less than 120 emu/g and the anisotropic magnetic field ($H_A$) is also as low as about 30 kOe for the (x+z) of 12 or less (Samples Nos. 18 and 19).

In a contrast to the above, when x falls within a range between 10 and 12.5 and (x+z) exceeds 12 (Samples Nos. 9 to 16), there can be obtained a single phase consisting of the 1-12 phase, and having such properties as a saturation magnetization (σs) of 120 emu/g or more and an anisotropic magnetic field ($H_A$) of 50 kOe or more.

Experimental Example 3

Figure 10A:
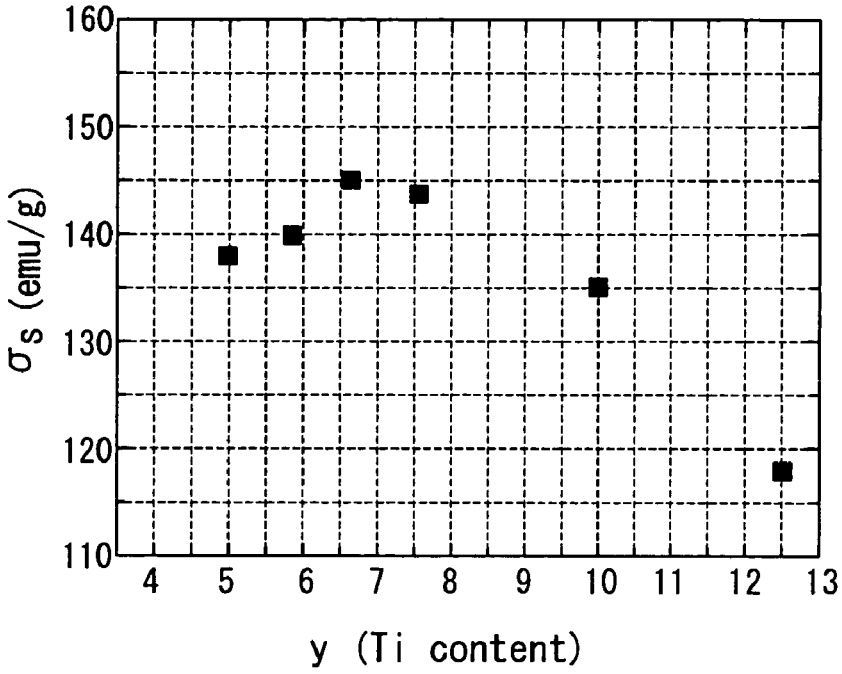
FIG. 10A is a graph showing the relation between the Ti content and the saturation magnetization (σs)
Figure 10B:
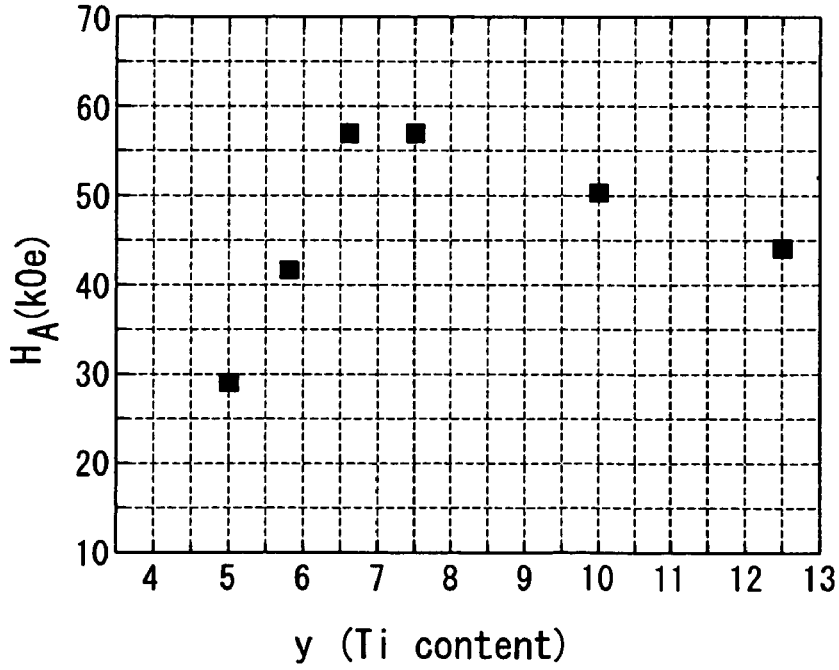
FIG. 10B is a graph showing the relation between the Ti content and the anisotropic magnetic field ($H_A$)
Figure 11A:
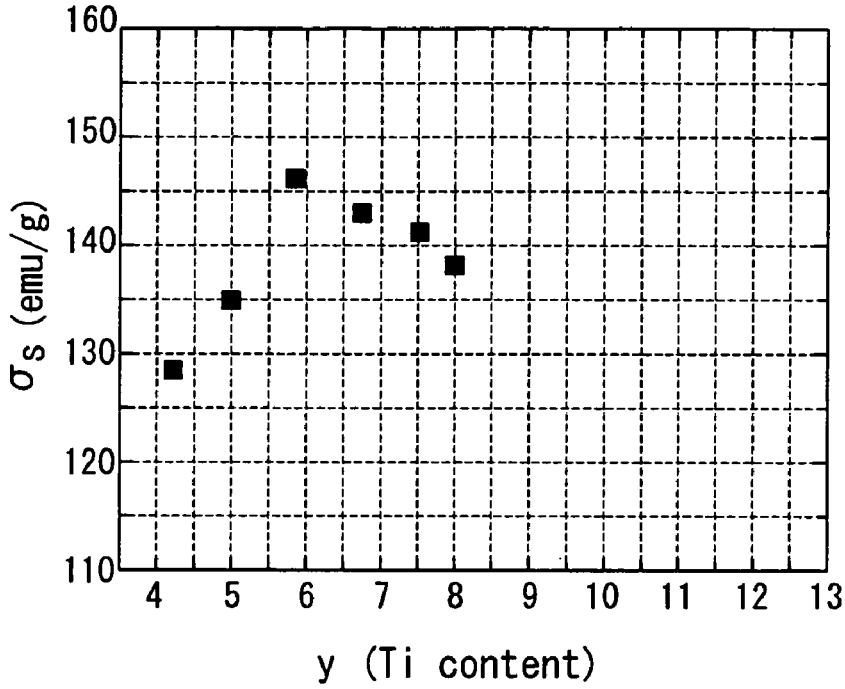
FIG. 11A is a graph showing the relation between the Ti content and the saturation magnetization (σs)
Figure 11B:
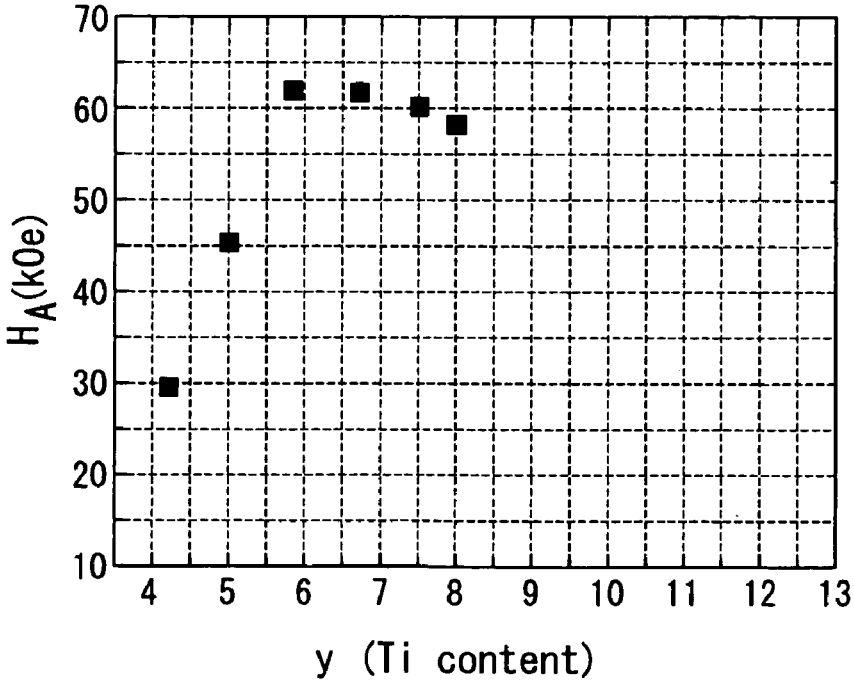
FIG. 11B is a graph showing the relation between the Ti content and the anisotropic magnetic field ($H_A$)
Figure 12A:
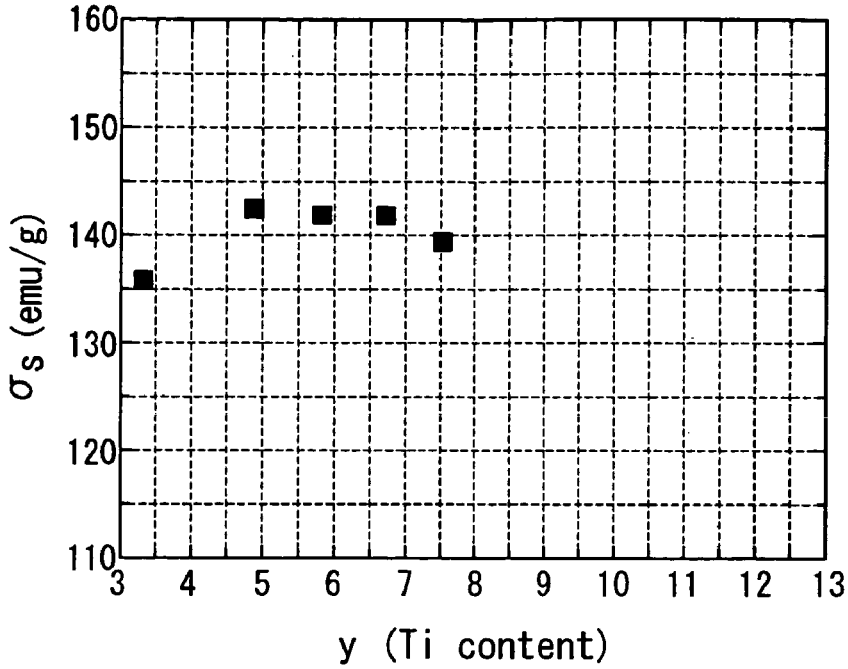
FIG. 12A is a graph showing the relation between the Ti content and the saturation magnetization (σs)
Figure 12B:
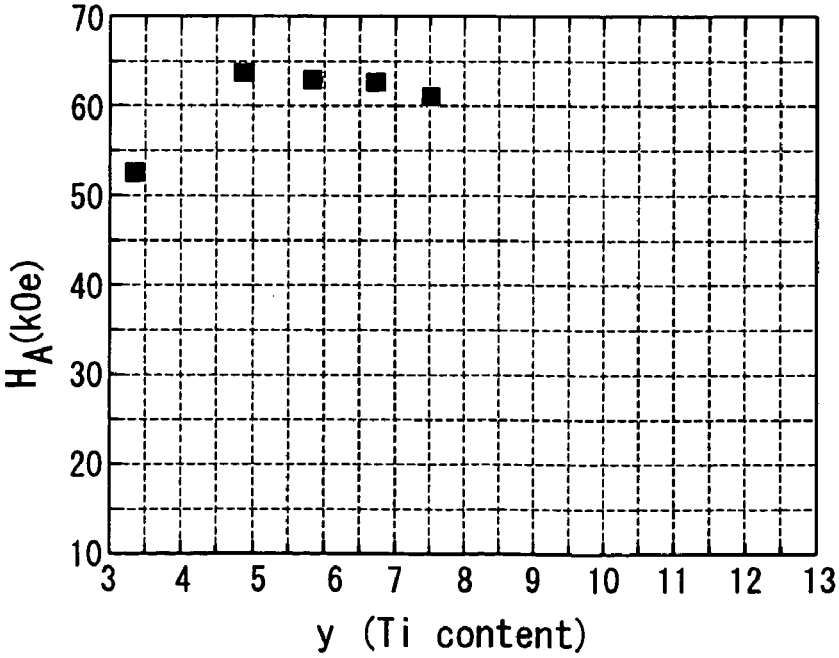
FIG. 12B is a graph showing the relation between the Ti content and the anisotropic magnetic field ($H_A$)

In the same manner as in Experimental Example 1, each sample was prepared in such a way that its composition concerned may be represented by $Nd—(Ti_yFe_{100-y})—Si_{1.0}—N_{1.5}$, $Nd—(Ti_yFe_{100-y})—Si_{1.5}—N_{1.5}$, or $Nd—(Ti_yFe_{100-y})—Si_{2.0}—N_{1.5}$. The samples were analyzed for chemical composition, identified for phases, and measured for saturation magnetization (σs) and anisotropic magnetic field ($H_A$). The composition, the magnetic properties and the phases of each of the samples obtained in Experimental Example 3 are shown in FIG. 9. The results of measurement of the saturation magnetization (σs) and the anisotropic magnetic field ($H_A$) for the Samples Nos. 23 to 25 and 33 to 35 are shown in FIGS. 10A and B, respectively. Similarly, the results of the measurement of the saturation magnetization (σs) and the anisotropic magnetic field ($H_A$) for the Samples Nos. 26 to 28, 36 and 37 are shown in FIGS. 11A and 11B, respectively. Additionally, the results of the measurement of the saturation magnetization (σs) and the anisotropic magnetic field ($H_A$) for the Samples Nos. 29 to 32 and 38 are shown in FIGS. 12A and 12B, respectively.

It is to be noted that Experimental Example 3 is an experiment carried out for the purpose of investigating the effects of the y (Ti content) on the phases, the saturation magnetization (σs) and the anisotropic magnetic field ($H_A$).

As shown in FIGS. 9 to 12, in any one of the cases where z (Si content) is 1.0, 1.5 and 2.0, when y (Ti content) is less than (8.3−1.7×z), α-Fe and moreover, the 2-17 phase segregate (Samples Nos. 33, 34, and 36 to 38). On the other hand, when y (Ti content) exceeds 12.3 to be 12.5, the saturation magnetization (σs) is decreased to be less than 120 emu/g (Sample No. 35).

On the contrary to the above, when y (Ti content) falls within a range between (8.3−1.7×z) and 12.3, a single phase composed of the 1-12 phase, namely, a structure of a single phase composed of the hard magnetic phase is obtained, and a saturation magnetization (σs) of 130 emu/g or more and moreover 140 emu/g or more, and an anisotropic magnetic field ($H_A$) of 50 kOe or more and moreover 55 kOe or more can be obtained (Samples Nos. 23 to 32).

Experimental Example 4

Figure 14A:
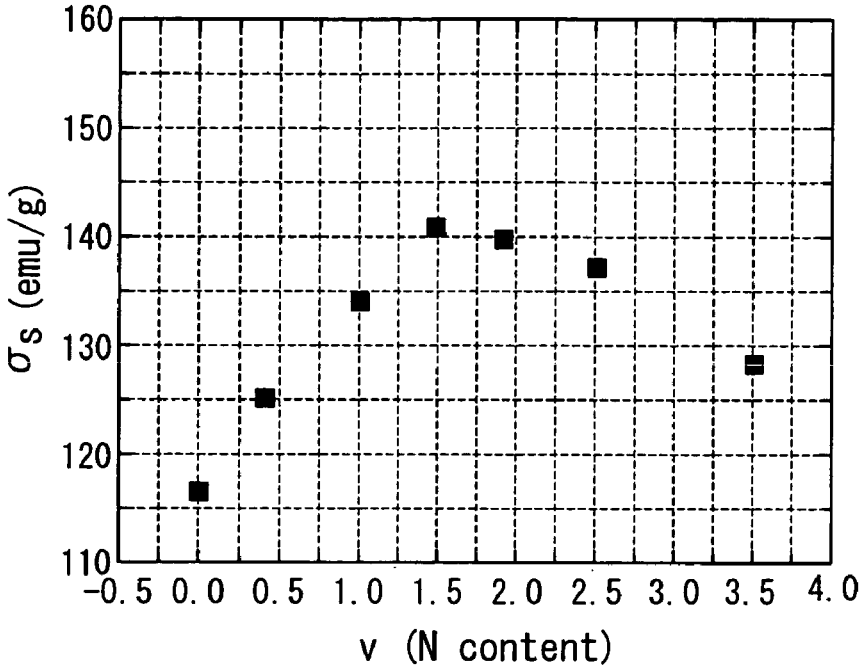
FIG. 14A is a graph showing the relation between the N content and the saturation magnetization (σs)

In the same manner as in Experimental Example 1, each sample was prepared in such a way that the composition concerned may be represented by Nd—$(Ti_{8.3}Fe_{91.7})_{12}$—$Si_{2.0}$—$N_v$. The samples obtained each were analyzed for chemical composition, identified for phases, and measured for saturation magnetization (σs) and anisotropic magnetic field ($H_A$). The composition, the magnetic properties and the phases each of the samples obtained in Experimental Example 4 are shown in FIG. 13. The results of measurement of the saturation magnetization (σs) and the anisotropic magnetic field ($H_A$) for the Samples Nos. 39 to 44 are shown in FIGS. 14A and B, respectively.

It is to be noted that Experimental Example 4 is an experiment carried out for the purpose of investigating the effects of the v (N content) on the phases, the saturation magnetization (σs) and the anisotropic magnetic field ($H_A$).

Figure 14B:
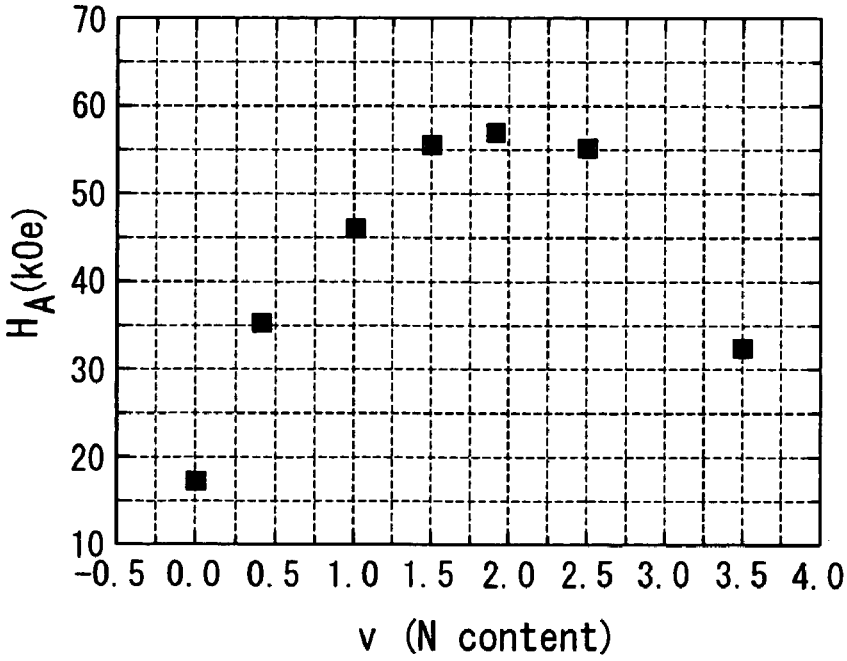
FIG. 14B is a graph showing the relation between the N content and the anisotropic magnetic field ($H_A$)

As shown in FIGS. 13 and 14, when v (N content) is null, both of the saturation magnetization (σs) and the anisotropic magnetic field ($H_A$) are low (Sample No. 43). On the other hand, when v (N content) exceeds 3 to be 3.5, α-Fe segregates (Sample No. 44).

On the contrary to the above, when v (N content) falls within a range between 0.1 and 3, a single phase composed of the 1-12 phase, namely, a structure of a single phase composed of the hard magnetic phase is obtained, and a saturation magnetization (σs) of 120 emu/g or more and an anisotropic magnetic field ($H_A$) of 30 kOe or more can be obtained (Samples Nos. 39 to 42). From the viewpoint of the saturation magnetization (σs) and the anisotropic magnetic field ($H_A$), it is preferable that v (N content) is set within a range between 0.5 and 2.7, and moreover, between 1.0 and 2.5.

Experimental Example 5

In the same manner as in Experimental Example 1, each of the samples shown in FIG. 15 was prepared and subjected to the identification of the formed phase, and the measurements of the saturation magnetization (σs) and the anisotropic magnetic field ($H_A$). The results obtained are shown in FIG. 15.

It is to be noted that Experimental Example 5 is an experiment carried out for the purpose of investigating the dependence on the w (Co content) in Nd—$(Ti_{8.3}Fe_{91.7-w}Co_w)_{12}$—$Si_z$—$N_{1.5}$.

As can be seen from FIG. 15, in any one of the case where z (Si content) is 0.25 and the case where z (Si content) is 1.0, the saturation magnetization (σs) and the anisotropic magnetic field ($H_A$) are improved by increasing w (Co content), and such improvement effect reaches a peak for w (Co content) of about 20. Accordingly, in consideration of the fact that Co is expensive, w (Co content) is preferably 30 or less, and is more preferably set within a range between 10 and 25. Within this range of w (Co content), the structure is of the single phase composed of the 1-12 phase.

Experimental Example 6

High purity Nd, Fe, Ti and Si metals were used as raw materials, and each sample was prepared by means of the arc melting method in an Ar atmosphere in such a way that its alloy composition may be represented by Nd—$(Ti_{8.3}Fe_{91.7-w}Co_w)_{12}$—$Si_z$. Successively, each alloy was milled with a stamp mill and passed through a sieve with opening of 38 μm, and thereafter mixed with a C powder having a mean particle size of 1 μm or less, and then the mixture thus obtained was heat-treated so as to be maintained at 400 to 600° C. for 24 hours in an Ar atmosphere. After the heat treatment, each of the samples was subjected to a chemical composition analysis and an identification of the formed phases, and measurements of the saturation magnetization (σs) and the anisotropic magnetic field ($H_A$) The results obtained are shown in FIG. 16.

As shown in FIG. 16, also by adding C in place of N, the single phase consisting of the 1-12 phase can be obtained, and additionally, a saturation magnetization (σs) of 120 emu/g or more and an anisotropic magnetic field ($H_A$) of 30 kOe or more can be obtained. In this case, C plays the same role as N.

Additionally, even when 1 to 25% of Nd is substitute with Pr, the same results as obtained for the other samples can be obtained.

Example 2

The results of the experiments (Experimental Examples 7 to 14) carried out for the purpose of investigating the variations of the magnetic properties caused by partial substitution of Nd with Zr or Hf will be described below as Example 2. In Experimental Examples 7 to 13, Nd is partially substituted with Zr, while in Experimental Example 14, Nd is partially substituted with Hf.

Experimental Example 7

High purity Nd, Zr, Fe, Ti and Si metals were used as raw materials, and each sample was prepared by means of the arc melting method in an Ar atmosphere in such a way that its alloy composition may be represented by $Nd_{1-x}Zr_x(Ti_{8.3}Fe_{91.7})_{12}Si_{1.0}$. Successively, according to the same procedures as in Example 1, each of the samples was subjected to the milling and the heat treatment (nitriding). After the heat treatment, each of the samples was subjected to a chemical composition analysis and an identification of the formed phases, and, under the same conditions as in Example 1, measurements of the saturation magnetization (σs) and the anisotropic magnetic field ($H_A$) were carried out. The results obtained are shown in FIG. 17.

As shown in FIG. 17, by partially replacing Nd by Zr, a saturation magnetization (σs) of 140 emu/g or more can be obtained. The improvement effect of the saturation magnetization (σs) provided by Zr exhibits a peak at a Zr content (u) of 0.05, and the Zr content exceeding this value tends to decrease the saturation magnetization (σs); and when the Zr content (u) comes to be 0.20, saturation magnetization (σs) becomes lower than when Zr is not contained. Additionally, when the Zr content (u) falls within a range between 0.02 and 0.15, the single phase consisting of the $ThMn_{12}$ phase (hereinafter referred to as the 1-12 phase) is obtained.

From the above, the Zr content (u) is preferably set within a range between 0.01 and 0.18, and more preferably within a range from 0.04 and 0.06, on the basis of the general formula $R1_{1-u}R2_u(Ti_yFe_{100-y-w}Co_w)_xSi_zA_v$.

For each of the samples having been subjected to the heat treatment, the identification of the formed phases was carried out by the X-ray diffraction method. The conditions of the X-ray diffraction were set to be the same as in Example 1, and the presence or absence of the peaks of the $ThMn_{12}$ phase and the peaks of the phases other than the $ThMn_{12}$ phase was investigated. As for the other phases, there can be cited α-Fe, the $Mn_2Th_{17}$ phase and a nitride of Nd. For the purpose of obtaining high magnetic properties, it is preferable that the main diffraction lines of the phases other than the $ThMn_{12}$ phase have peak intensity ratios of 50% or less in relation to the main diffraction line of the $ThMn_{12}$ phase. Specific examples of the identification of the formed phases will be described below on the basis of FIGS. 18 and 19.

Figure 18:
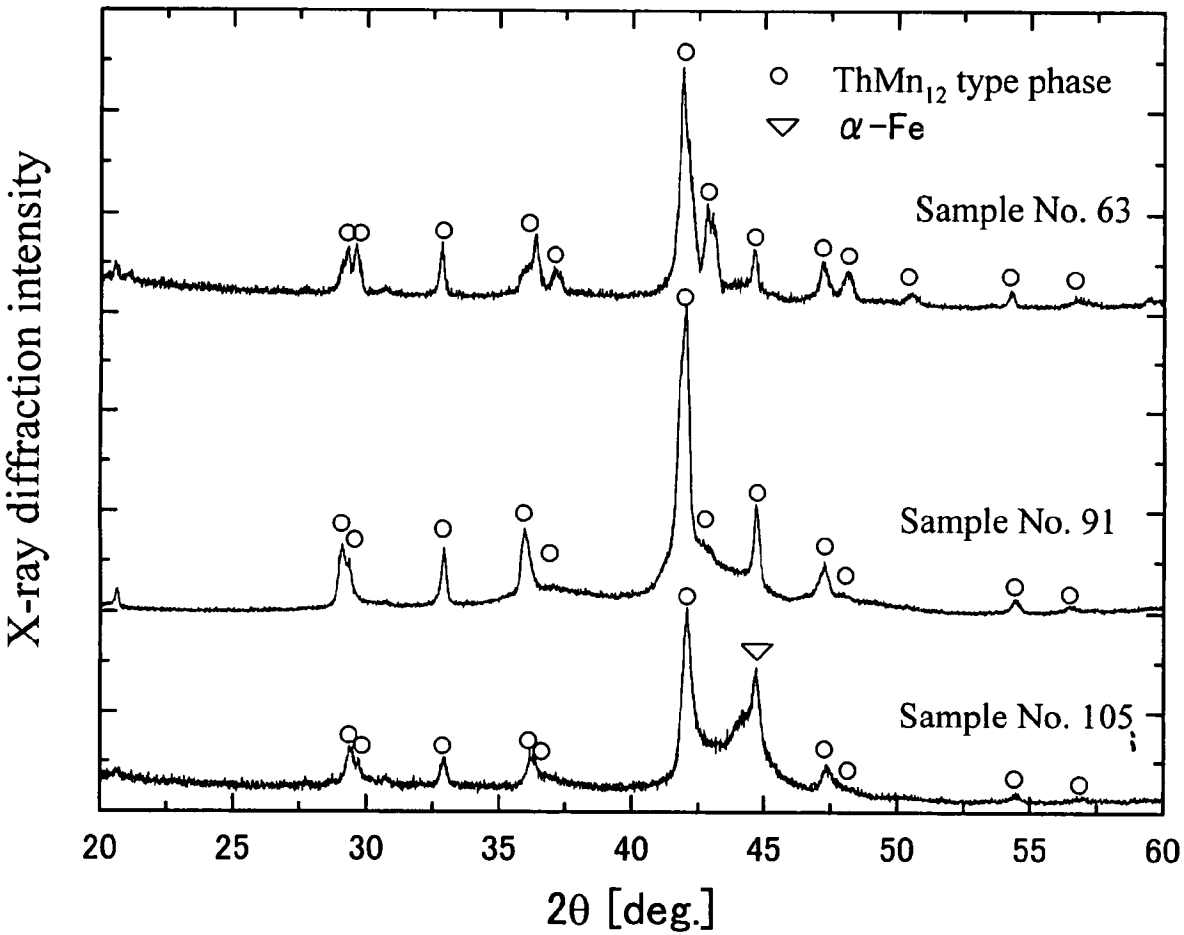
FIG. 18 is a chart showing the results of X-ray diffraction for Samples Nos. 63, 91 and 105.

FIG. 18 is a chart showing the results of the X-ray diffraction measurement for Samples Nos. 63, 91 and 105 to be described later; in Samples Nos. 63 and 91, only the peaks exhibiting the $ThMn_{12}$ phase were observed. On the contrary, in Sample No. 105, the peak of α-Fe was able to be verified. It is assumed that in Sample No. 105, the N content was excessive and the $ThMn_{12}$ phase was thereby decomposed and accordingly α-Fe segregated. This can be seen from the fact that in Sample No. 105, the peaks of the $ThMn_{12}$ phase are decreased in intensity, while the peak of α-Fe grows.

Figure 19:
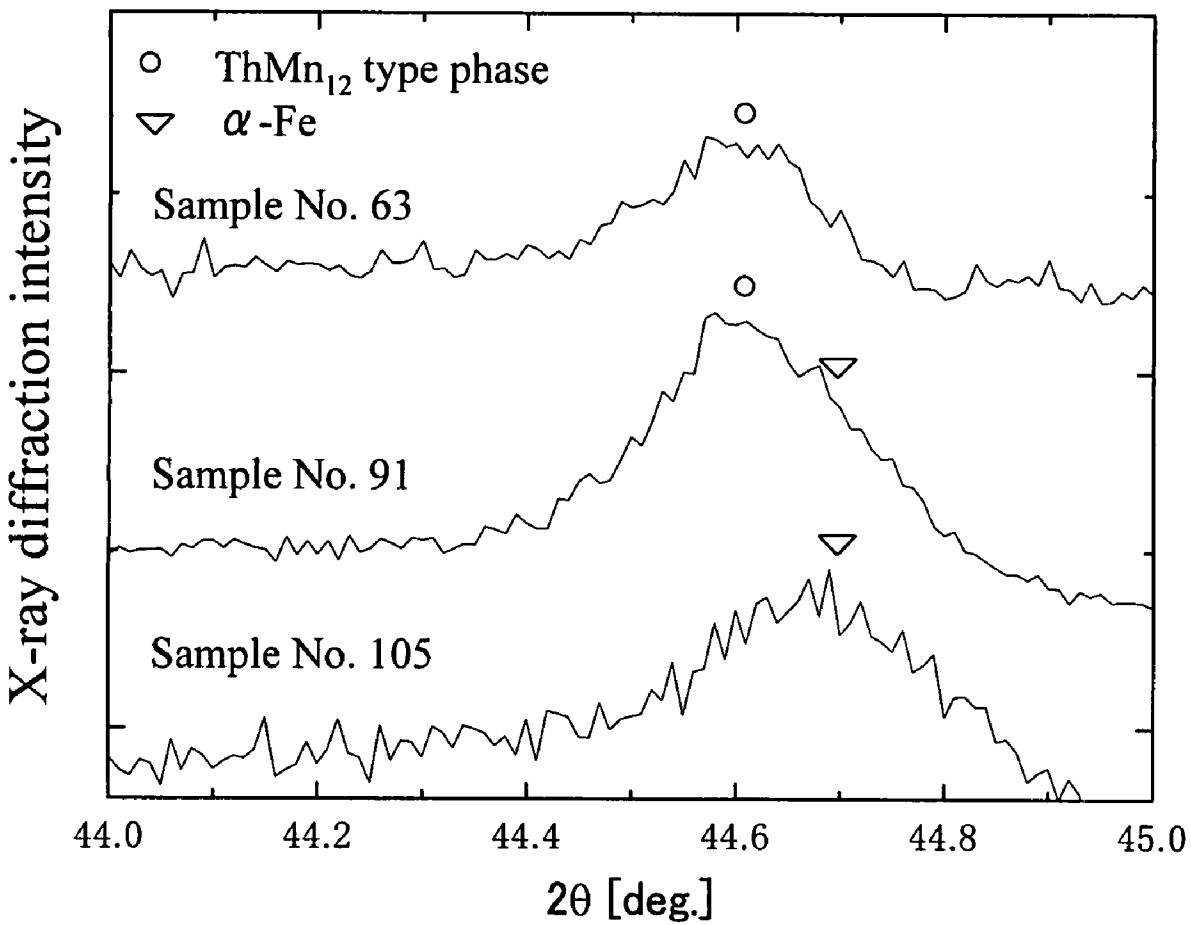
FIG. 19 is an enlarged chart for the vicinity of the diffraction angle where the peak of α-Fe generates.

FIG. 19 is an enlarged chart for the vicinity of the diffraction angle generating the α-Fe peak. In the vicinity of this angle, the peak of the $ThMn_{12}$ phase and the peak of α-Fe are close to each other. In Sample No. 63, only the peak of the $ThMn_{12}$ phase was observed. In Sample No. 91, two peaks, namely, the peak of the $ThMn_{12}$ phase and the peak of α-Fe were observed, but in a case where such a small amount of α-Fe is involved, the effect on the properties is small. On the other hand, in Sample No. 105, almost only the peak of α-Fe was observed, and as can be seen from FIG. 18, the peak intensity ratio of the main diffraction line of α-Fe to the main diffraction line of the $ThMn_{12}$ phase observed in the vicinity of 42° is 50% or more. When such a large amount of α-Fe segregates, the degradation of the properties becomes remarkable.

Experimental Example 8

In the same procedures as in Experimental Example 7, each sample was prepared in such a way that the composition concerned may be represented by $Nd_{0.95}Zr_{0.05}(Ti_{8.3}Fe_{91.7})_{12}Si_uN_{1.5}$. The samples obtained each were analyzed for chemical composition, identified for phases, and measured for saturation magnetization (σs) and anisotropic magnetic field ($H_A$). The results obtained are shown in FIG. 20.

It is to be noted that Experimental Example 8 is an experiment carried out for the purpose of investigating the effects of Si content (z) on the phases, the saturation magnetization (σs) and the anisotropic magnetic field ($H_A$)

In Sample No. 69 having no added Si, the $Mn_2Th_{17}$ phase (hereinafter referred to as the 2-17 phase) and the α-Fe phase were present in addition to the 1-12 phase, and the anisotropic magnetic field ($H_A$) was particularly low. On the contrary, it was found that in each of Samples Nos. 70 to 73 having added Si, the phase was of the single phase composed of the 1-12 phase, and the 1-12 phase was stabilized. These compounds each showing the single phase composed of the 1-12 phase can acquire a saturation magnetization (σs) of 140 or 145 emu/g or more and an anisotropic magnetic field ($H_A$) of 50 or 55 kOe or more. However, in Sample No. 74 having a Si content of 2.5, α-Fe segregated in a larger amount and the properties were lowered. If soft magnetic α-Fe is present, the portion containing such α-Fe generates a reverse magnetic domain at a low magnetic field (demagnetizing field). Accordingly, the coercive force becomes small as a result of easily promoting the inversion of the magnetic domains in the hard magnetic phase component, and accordingly the presence of α-Fe is not desirable for permanent magnets required to have coercive force.

Within the scope of Samples Nos. 70 to 73, the anisotropic magnetic field ($H_A$) tends to be increased with increasing Si content, whereas the saturation magnetization (σs) tends to be increased with decreasing Si content.

Experimental Example 9

In the same procedures as in Experimental Example 7, each sample was prepared in such a way that the composition concerned may be represented by $Nd_{0.95}Zr_{0.05}(Ti_{8.3}Fe_{91.7})_xSi_{0.5}N_{1.5}$, $Nd_{0.95}Zr_{0.05}(Ti_{8.3}Fe_{91.7})_xSi_{1.0}N_{1.5}$, or $Nd_{0.95}Zr_{0.05}(Ti_{8.3}Fe_{91.7})_xSi_{1.5}N_{1.5}$. The samples obtained each were analyzed for chemical composition, identified for phases, and measured for saturation magnetization (σs) and anisotropic magnetic field ($H_A$). The results obtained are shown in FIG. 21.

It is to be noted that Experimental Example 9 is an experiment carried out for the purpose of investigating the effects of the "Fe content+Co content+Ti content (x)" and the "Fe content+Co content+Ti content+Si content (x+z)" on the phases, the saturation magnetization (σs) and the anisotropic magnetic field ($H_A$).

As shown in FIG. 21, when the "Fe content+Co content+Ti content (x)" is less than 11 (Samples Nos. 81, 83, 84 and 86), the saturation magnetization (σs) is less than 140 emu/g. On the contrary, when x is 13 (Sample No. 85), α-Fe segregates in a larger amount and the properties are lowered. Additionally, even when x falls within a range between 11 and 12.5, if (x+z), namely, (molar ratio of Fe+molar ratio Co+molar ratio of Ti+molar ratio of Si)/(molar ratio of R1+molar ratio of R2) is lower than 12 to be 11.6 (Sample No. 82), the saturation magnetization (σs) exhibits a value of 140 emu/g or more, but the anisotropic magnetic field ($H_A$) is at the highest 40 kOe or lower.

On the contrary to the above, each of Samples Nos. 75 to 80 in which x falls within a range between 11 and 12.8 and (x+z) exceeds 12 has a saturation magnetization (σs) of 140 emu/g or more and an anisotropic magnetic field ($H_A$) of 50 kOe or more.

Experimental Example 10

In the same procedures as in Experimental Example 7, each sample was prepared in such a way that the composition concerned may be represented by $Nd_{0.95}Zr_{0.05}(Ti_yFe_{100-y})_{12}Si_{1.0}N_{1.5}$, $Nd_{0.95}Zr_{0.05}(Ti_yFe_{100-y})_{12}Si_{1.5}N_{1.5}$, or $Nd_{0.95}Zr_{0.05}(Ti_yFe_{100-y})_{12}Si_{2.0}N_{1.5}$. The samples obtained each were analyzed for chemical composition, identified for phases, and measured for saturation magnetization (σs) and anisotropic magnetic field ($H_A$). The results obtained are shown in FIG. 22.

It is to be noted that Experimental Example 10 is an experiment carried out for the purpose of investigating the effects of the Ti content (y) on the phases, the saturation magnetization (σs) and the anisotropic magnetic field ($H_A$).

In any one of the case where the Si content (z) is 1.5 and the case where it is 2.0, when the Ti content (y) is less than 5.0, α-Fe segregates and moreover, the 2-17 phase segregates, and both of the saturation magnetization (σs) and the anisotropic magnetic field ($H_A$) still remain at low values (Samples Nos. 94 and 99). On the other hand, the Ti content (y) exceeds 12.3 to be 12.5, the saturation magnetization (σs) is decreased to be less than 130 emu/g (Sample No. 90).

On the contrary to the above, each of Samples Nos. 87 to 89, 91 to 93, and 95 to 98, in which the Ti content (y) falls within a range between 5 and 12.3, takes a single phase composed of the 1-12 phase, namely, a single phase consisting of a hard magnetic phase, and can acquire a saturation magnetization (σs) of 140 or 150 emu/g or more and an anisotropic magnetic field ($H_A$) of 50 or 55 kOe or more.

Experimental Example 11

In the same procedures as in Experimental Example 7, each sample was prepared in such a way that the composition concerned may be represented by $Nd_{0.95}Zr_{0.05}(Ti_yFe_{100-y})_{12}Si_{1.0}N_v$. The samples obtained each were analyzed for chemical composition, identified for phases, and measured for saturation magnetization (σs) and anisotropic magnetic field ($H_A$). The results obtained are shown in FIG. 23.

It is to be noted that Experimental Example 11 is an experiment carried out for the purpose of investigating the effects of the N content (v) on the phases, the saturation magnetization (σs) and the anisotropic magnetic field ($H_A$).

As shown in FIG. 23, when the N content (v) is zero, both of the saturation magnetization (σs) and the anisotropic magnetic field ($H_A$) are low (Sample No. 100).

On the contrary to the above, Samples Nos. 101 to 104 in which the N content (v) falls within a range between 1 and 3 each shows a single phase composed of the 1-12 phase, namely, a single phase consisting of a hard magnetic phase, and can acquire a saturation magnetization (σs) of 140 emu/g or more and an anisotropic magnetic field ($H_A$) of 45 or 50 kOe or more. From the viewpoint of the saturation magnetization (σs) and the anisotropic magnetic field ($H_A$), it is preferable that the N content (v) is set to fall within a range between 0.5 and 2.7, and moreover, between 1.0 and 2.5.

Experimental Example 12

In the same procedures as in Experimental Example 7, each sample was prepared in such a way that the composition concerned may be represented by $Nd_{0.95}Zr_{0.05}(Ti_{8.3}Fe_{91.7-w}Co_w)_{12}Si_{0.25}N_{1.5}$ or $Nd_{0.95}Zr_{0.05}(Ti_{8.3}Fe_{91.7-w}Co_w)_{12}Si_{1.0}N_{1.5}$. The samples obtained each were identified for phases and measured for saturation magnetization (σs) and anisotropic magnetic field ($H_A$). The results obtained are shown in FIG. 24.

It is to be noted that Experimental Example 12 is an experiment carried out for the purpose of investigating the effects of the Co content (w) on the phases, the saturation magnetization (σs) and the anisotropic magnetic field ($H_A$).

As can be seen from FIG. 24, in any one of the case where the Si content (z) is 0.25 and the case where it is 1.0, both of the saturation magnetization (σs) and the anisotropic magnetic field ($H_A$) are improved by increasing Co content (w) and such an improvement effect reaches a peak for the Co content (w) of about 20. Accordingly, in consideration of the fact that Co is expensive, the Co content (w) is preferably 30 or less, and more preferably set to fall within a range between 10 and 25. Within this range of the Co content (w), the structure is of the single phase composed of the 1-12 phase.

Experimental Example 13

High purity Nd, Zr, Fe, Ti and Si metals were used as raw materials, and each sample was prepared by means of the arc melting method in an Ar atmosphere in such a way that its alloy composition may be represented by $Nd_{0.95}Zr_{0.05}(Ti_{8.3}Fe_{91.7-w}Co_w)_{12}Si_z$. Successively, the alloy was milled with a stamp mill and passed through a sieve with opening of 38 μm, and thereafter mixed with a C powder having a mean particle size of 1 μm or less, and then the mixture thus obtained was heat-treated so as to be maintained at 400 to 600° C. for 24 hours in an Ar atmosphere. After the heat treatment, each of the samples was subjected to a chemical composition analysis and an identification of the formed phases, and measurements of the saturation magnetization (σs) and the anisotropic magnetic field ($H_A$). The results obtained are shown in FIG. 25.

As shown in FIG. 25, also by adding C in place of N, the single phase consisting of the 1-12 phase can be obtained, and additionally, a saturation magnetization (σs) of 140 or 150 emu/g or more and an anisotropic magnetic field ($H_A$) of 40 kOe or more can be obtained. In this case, C plays the same role as N.

Experimental Example 14

The results of an experiment carried out for the purpose of investigating the variations of the magnetic properties due to partial substitution of Nd with Hf will be described below as Experimental Example 14.

In the same procedures as in Experimental Example 7, each sample was prepared in such a way that the composition concerned may be represented by $Nd_{1-u}Hf_u(Ti_{8.3}Fe_{91.7})_{12}Si_{1.0}N_{1.5}$. The samples obtained each were analyzed for chemical composition, identified for phases, and measured for saturation magnetization (σs) and anisotropic magnetic field ($H_A$) The results obtained are shown in FIG. 26.

As can be seen from FIG. 26, Hf has a similar effect to Zr.

Example 3

The results of experiments (Experimental Examples 15 and 16) carried out for the purpose of investigating the variations of the c/a caused by inclusion of Si will be described below as Example 3.

Experimental Example 15

High purity Nd, Fe, Ti and Si metals were used as raw materials, and each sample was prepared by means of the arc melting method in an Ar atmosphere in such a way that its alloy composition may be represented by $Nd—(Ti_{8.2}Fe_{91.8})_{11.9}—Si_z$ or $Nd—(Ti_{8.3}Fe_{91.7})_{12}—Si_z$. Successively, the alloy was milled with a stamp mill and passed through a sieve with opening of 38 μm, and thereafter subjected to a heat treatment (nitriding) in which the mixture was maintained at 430 to 520° C. for 100 hours in an nitrogen atmosphere. After the heat treatment, each of the samples was subjected to a chemical composition analysis and an identification of the formed phases, and under the same conditions as in Example 1, measurements of the saturation magnetization (σs) and the anisotropic magnetic field ($H_A$). The results obtained are shown in FIG. 27.

The identification of the phases was carried out on the basis of the X-ray diffraction method and the measurement of the thermomagnetic curve, in the same manner as in Example 1.

As can be seen from FIG. 27, in Samples Nos. 121 to 126, each having a larger c/a value than the c/a value of 0.552 of Sample No. 129 having no added Si, the magnetic properties, in particular, the anisotropic magnetic field ($H_A$) is improved. However, also by referring to FIG. 28, it can be seen that the anisotropic magnetic field ($H_A$) is improved with decreasing lattice constant of the a-axis until the lattice constant concerned is decreased to fall in a predetermined range, whereas the saturation magnetization (σs) tends to be decreased. In Sample No. 131 rich in the Si content, α-Fe segregates and both of the saturation magnetization (σs) and the anisotropic magnetic field ($H_A$) are decreased. In Sample No. 130 with no added N, the saturation magnetization (σs) is low. As compared to the levels of the saturation magnetization (σs) and the anisotropic magnetic field ($H_A$) of Sample No. 129 which contains N but not Si and those of Sample No. 130 which contains Si but not N, the saturation magnetization (σs) and the anisotropic magnetic field ($H_A$) of each of Samples Nos. 121 to 126, according to the present invention, exhibit high values exceeding expected ranges, revealing that simultaneous inclusion of Si and N remarkably improve the magnetic properties.

Figure 28:
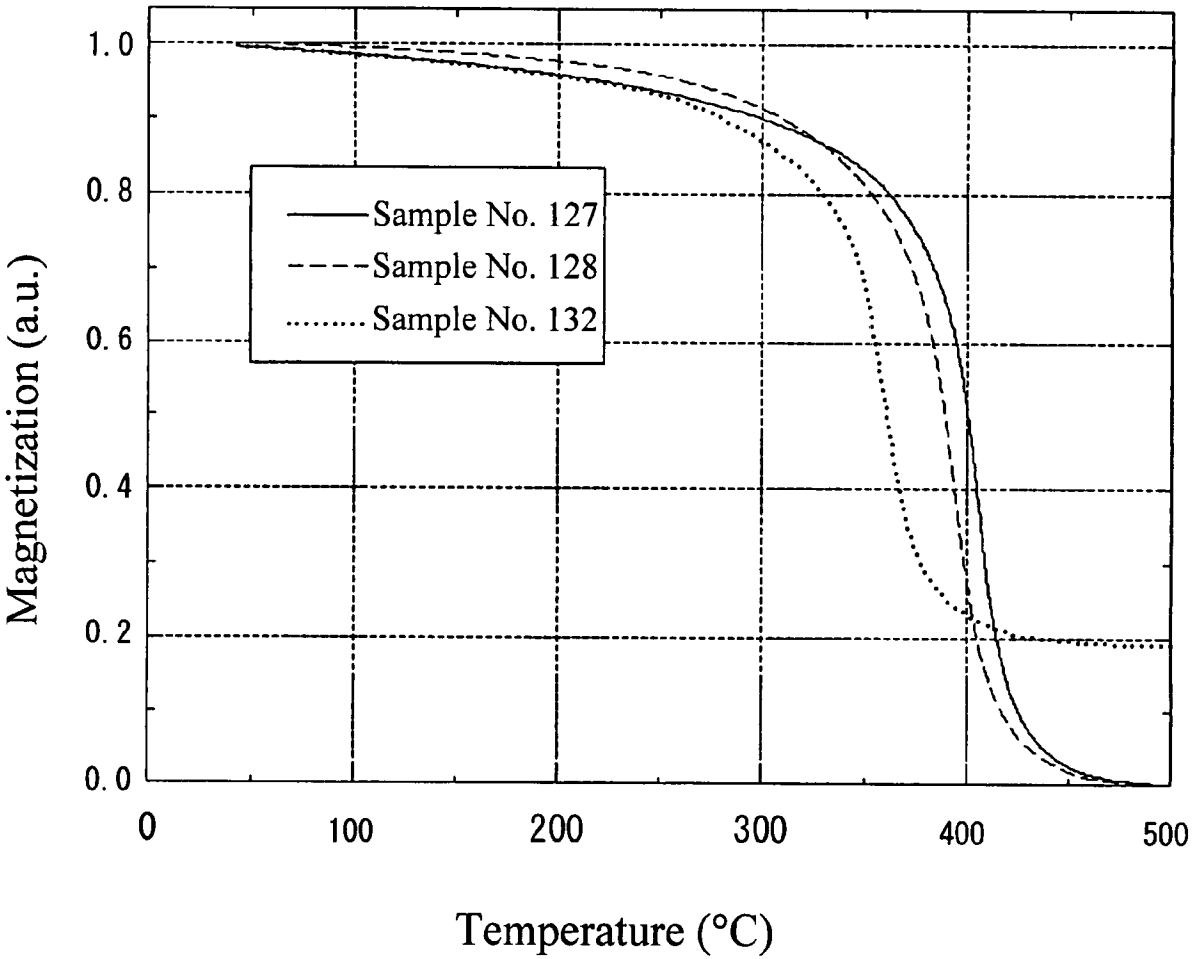
FIG. 28 is a graph showing the thermomagnetic curves for the samples obtained in Example 3.

FIG. 28 shows the thermomagnetic curves for the compositions of Samples Nos. 127, 128 and 132 compiled in FIG. 27. For each of Samples Nos. 127 and 128, the Tc is found in the vicinity of 430° C., but no other Tc can be identified. Accordingly, Samples Nos. 127 and 128 each are taken to be of a single phase consisting of the $ThMn_{12}$ phase. For Sample No. 132, the Tc for a first phase can be identified in the vicinity of 400° C. Additionally, at 450° C., Sample No. 132 holds a magnetization corresponding to 20% of the magnetization at room temperature. This indicates that Sample No. 132 has a magnetic phase having a Tc of 450° C. or more. With increasing measurement temperature, the magnetization thereof comes to be lost in the vicinity of 770° C., and accordingly, the existence of a second phase can be identified. From these results and the results of the X-ray diffraction, this second phase can be taken as α-Fe.

Experimental Example 16

The compounds shown in FIG. 29 were obtained in the same manner as in Experimental Example 15. For each of these compounds, in the same manner as in Experimental Example 15, the measurements of the saturation magnetization (σs) and the anisotropic magnetic field ($H_A$), and the identification of the formed phases were carried out. The results obtained are shown in FIG. 29.

As shown in FIG. 29, Samples Nos. 133 to 137 each having an (Fe+Ti) content (x), namely, the ratio of (Fe+Ti) to R falling within a range between 10 and 12.5 acquire high magnetic properties such as a saturation magnetization (σs) of 120 or 130 emu/g or more and an anisotropic magnetic field ($H_A$) of 55 kOe or more. Additionally, the compounds based on Samples Nos. 133 to 137 each show a single phase consisting of the $ThMn_{12}$ phase. On the contrary, in Sample No. 138 having a ratio of (Fe+Ti) to R of 12.7, the segregation of α-Fe has been verified in addition to the segregation of a compound having the $ThMn_{12}$ phase. Additionally, in Samples Nos. 133 to 137, with decreasing ratio of (Fe+Ti) to R, the single phase remains, but both of the saturation magnetization (σs) and the anisotropic magnetic field ($H_A$) are decreased. From this tendency, the ratio of (Fe+Ti) to R is preferably set at 10 or more.

Example 4

Examples shown above (Examples 1 to 3) are all related to hard magnetic compounds. In Example 4, specific examples related to permanent magnet powders will be presented.

Experimental Example 17

The raw materials weighed so as to give the composition shown below were melted in an Ar atmosphere, and subjected to quenching and solidification. The quenching and solidification conditions are as follows.

The obtained alloy consisted of 20 μm thick flakes. These flakes heat-treated so as to be maintained at 800° C. in an Ar gas atmosphere for 2 hours.

Moreover, the heat treated flakes were milled with a stamp mill to a size capable of passing a sieve having opening of 75 μm, and the thus milled powder was subjected to nitriding. The nitriding conditions are such that the treatment temperature is 400° C., treatment time is 64 hours and the atmosphere is a flow of $N_2$ (at atmospheric pressure)

Composition: $Nd_1Fe_{9.15}Co_{2.0}Ti_{0.85}Si_{0.2}$

Single roll casting method (the material of the roll: Cu)

Nozzle hole diameter: ϕ1 mm

Pressure of gas jet: 0.5 kg/cm$^2$

Temperature of melt: 1400° C.

Roll peripheral velocity (Vs): 15, 25, 50 and 75 m/s

Figure 30:
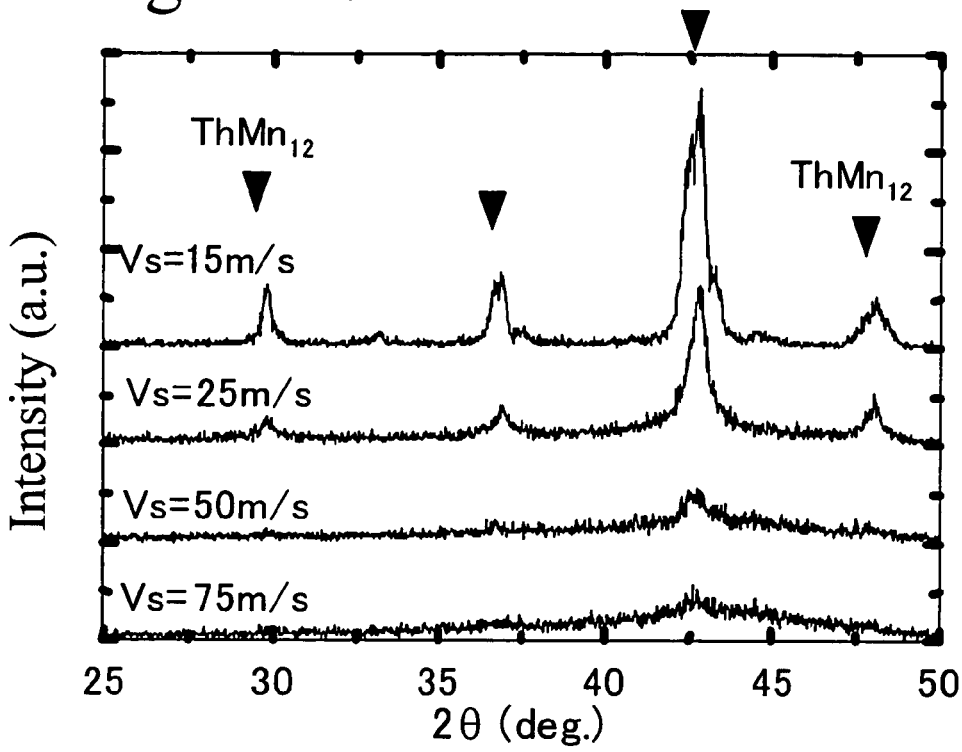
FIG. 30 is a chart showing the results of X-ray diffraction for flakes subsequent to quenching and solidification.
Figure 31:
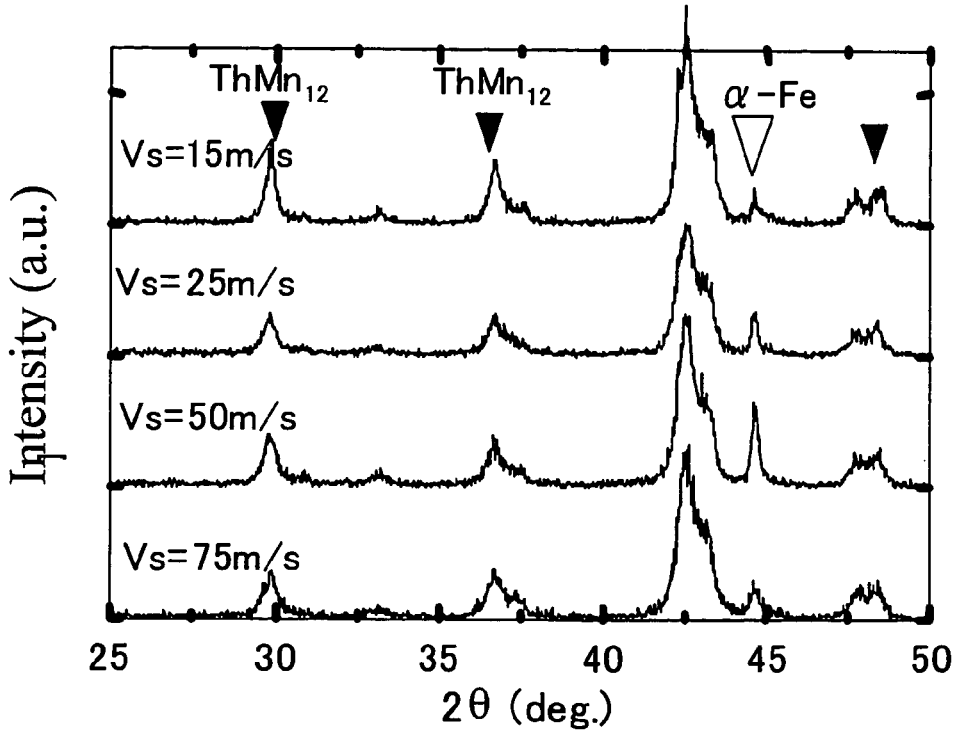
FIG. 31 is a chart showing the results of X-ray diffraction for samples subsequent to heat treatment.

For each of the quenched and solidified flakes (sample) and the heat-treated sample, the phases was observed by means of an XRD (X-Ray Diffractometer). The results obtained are shown in FIGS. 30 and 31. FIG. 30 shows the results observed for the quenched and solidified sample, while FIG. 31 shows the results observed for the heat-treated sample.

As shown in FIG. 30, the peaks of the $ThMn_{12}$ phase were observed in the samples obtained with the roll peripheral velocities (Vs) of 15 and 25 m/s, whereas the peaks of the $ThMn_{12}$ phase were not observed but diffraction lines characteristic to amorphous phases were observed in the samples obtained with the roll peripheral velocities (Vs) of 50 and 75 m/s.

As shown in FIG. 31, it has been verified that after heat treatment, any one of the above mentioned roll peripheral velocities results in the $ThMn_{12}$ phase dominating the main phase.

Figure 32:
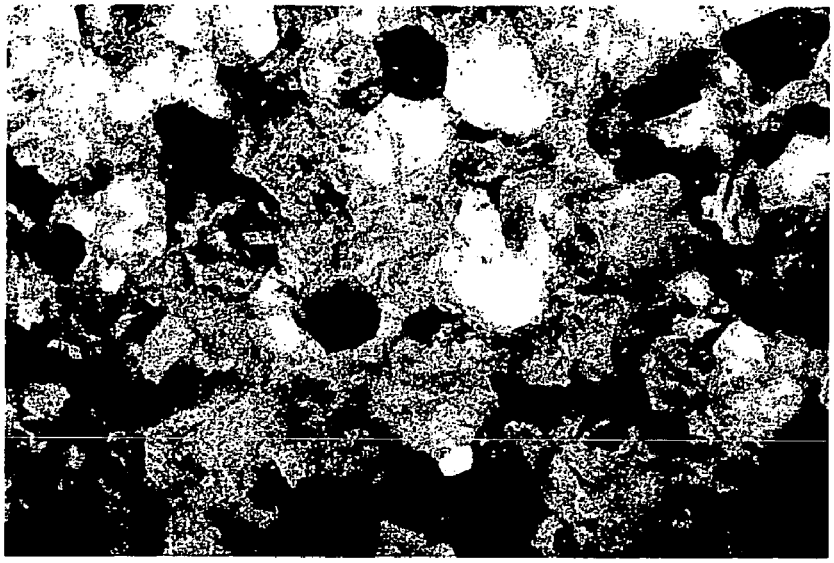
FIG. 32 is a figure showing a result of observation by TEM of the structure of the flake obtained with a roll peripheral velocity (Vs) of 25 m/s and then subjected to heat treatment.
Figure 33:
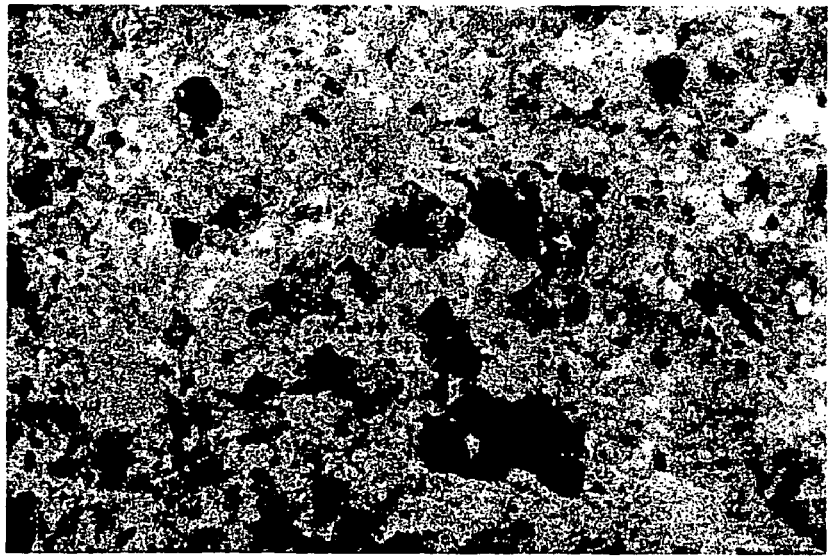
FIG. 33 is a figure showing a result of observation by TEM of the structure of the flake obtained with a roll peripheral velocity (Vs) of 75 m/s and then subjected to heat treatment.

FIG. 32 is an image showing the results of the TEM (Transmission Electron Microscope) observation of the structure of the sample obtained with the peripheral velocity of a roll (Vs) of 25 m/s and subjected to the heat treatment. FIG. 33 is an image showing the results of the TEM observation of the structure of the sample obtained with the roll peripheral velocity (Vs) of 75 m/s and subjected to the heat treatment.

As shown in FIGS. 32 and 33, it has been able to be verified that after the heat treatment, extremely fine nanostructure is exhibited. More specifically, the structure found after heat treatment varies as follows depending on the roll peripheral velocity (Vs): in the sample obtained with the roll peripheral velocity (Vs) of 25 m/s, many grains having a grain size of about 25 nm were observed, and the largest grain size is about 50 nm; on the contrary, in the sample obtained with 75 m/s, a large number of grains having a grain size of about 10 nm were observed, and the largest grain size is about 100 nm.

Next, the magnetic properties of the samples after quenching and solidification, after heat treatment and after nitriding were measured by using a VSM (applied magnetic field: 20 kOe). The results obtained are shown in FIG. 34. The N contents of the samples after nitriding are as follows:

Roll peripheral velocity (Vs)=25 m/s: 2.93 wt %

Roll peripheral velocity (Vs)=75 m/s: 2.79 wt %

As shown in FIG. 34, it has been verified that by applying nitriding after heat treatment, both the coercive force (Hcj) and the remanent magnetization (σr) are improved, and the sufficient properties as a permanent magnet are obtained. In FIG. 34, the measurement results of the magnetic properties of a powder obtained in Comparative Example to be described below are also shown; both of the coercive force (Hcj) and the remanent magnetization (σr) thereof still remain at lower values as compared to Example.

Comparative Example: Raw materials were weighed so as to give the same composition ($Nd_1Fe_{9.15}Co_{2.0}Ti_{0.85}Si_{0.2}$) as in the present example, the mixture of the raw materials was melted by high frequency melting, the obtained melt was cast into a water-cooled Cu mold to produce an alloy (the thickness of the alloy: 10 mm). The alloy was milled with a stamp mill in the same manner as in Example, and the milled alloy was subjected to the same heat treatment and the same nitriding as in the present Example to yield a powder.

Next, an epoxy resin was mixed in a content of 3 wt % in the powder subjected to the nitriding(the relevant roll peripheral velocity (Vs): 50 m/s), and the mixture thus obtained was stirred and compacted by use of a die having a ϕ10 mm cylindrical cavity at a compacting pressure of 6 ton/cm$^2$ to obtain a compact. The compact was subjected to a curing treatment at 150° C. for 4 hours to yield a bonded magnet. The bonded magnet was subjected to a measurement of magnetic properties with a B—H tracer (applied magnetic field: 25 kOe). The results obtained are as follows:

Br=6700 *G*, *Hcj*=7980 *Oe*, (BH)max=8.5 *MGOe*.

Experimental Example 18

Quenched and solidified alloys having the compositions shown in FIG. 35 were produced, and then the alloys were subjected to the heat treatment and the nitriding. The conditions for the quenching and solidification, heat treatment and nitriding are as follows. The magnetic properties of the alloys were measured after having been subjected to the nitriding, and the results obtained are shown in FIG. 35.

—Quenching and Solidification—

Single roll casting method (the material of the roll: Cu)

Nozzle hole diameter: ϕ1 mm

Pressure of gas jet: 0.5 kg/cm$^2$

Melting temperature: 1400° C.

Roll peripheral velocity (Vs): 50 m/s

—Heat Treatment—

Retention at 800° C. for 2 hours in an Ar gas atmosphere

—Nitriding—

Retention at 400° C. for 64 hours in a flow of $N_2$ gas (at atmospheric pressure)

As shown in FIG. 35, it can be verified that the application of the nitriding after the heat treatment is effective for the purpose of obtaining a permanent magnet powder provided with high magnetic properties.

INDUSTRIAL APPLICABILITY

According to the present invention, there can be provided a hard magnetic compound in which even when Nd is used as a rare earth element, the $ThMn_{12}$ phase is easily generated. In particular, according to the present invention, even when the content of Nd is 100 mol %, there can be obtained a hard magnetic compound which shows a single phase consisting of the $ThMn_{12}$ phase, namely, a hard magnetic phase.

Additionally, according to the present invention, there can be obtained a hard magnetic compound showing a single phase in which both of the saturation magnetization and the anisotropic magnetic field are high, by use of an intermetallic compound in which Si which anisotropically shrinks the crystal lattice and N which isotropically expands the crystal lattice are made to be included as interstitial elements, and the ratio of T to R is made to fall in the vicinity of 12.

Moreover, according to the present invention, there can be provided a permanent magnet powder which can easily generate the $ThMn_{12}$ phase even when Nd is used as a rare earth element, and a method for producing the permanent magnet powder. Additionally, according to the present invention, there can be obtained a bonded magnet for which such a permanent magnet powder is used.

The invention claimed is:

1. A hard magnetic compound, characterized in that:

the hard magnetic compound is represented by a general formula $R(Fe_{100-y-w}Co_wTi_y)_xSi_zA_v$ (in the general formula, R is at least one element selected from rare earth elements (here the rare earth elements signify a concept inclusive of Y), Nd accounts for 50 mol % or more of R, and A is N and/or C); and the molar ratios in said general formula are such that x=10 to 12.5, y=(8.3−1.7×z) to 12.3, z=0.1 to 2.3, v=0.1 to 3 and w=0 to 30, and the relation (Fe+Co+Ti+Si)/R>12 is satisfied; wherein said hard magnetic compound shows a single phase consisting of a phase having a $ThMn_{12}$-type structure.

2. The hard magnetic compound according to claim 1, characterized in that Nd accounts for 70 mol % or more of said R.

3. The hard magnetic compound according to claim 1, characterized in that said R is partially substituted with Zr and/or Hf.

4. A hard magnetic compound, characterized in that:

the hard magnetic compound is represented by a general formula $R1_{1-u}R2_u(Fe_{100-y-w}Co_wTi_y)_xSi_zA_v$(in the general formula, R1 is at least one element selected from rare earth elements (here, the rare earth elements signify a concept inclusive of Y), Nd accounts for 50 mol % or more of said R1, R2 is Zr and/or Hf and A is N and/or C); and the molar ratios in said general formula are such that u=0.18 or less, y=4.5 to 12.3, x=11 to 12.8, z=0.1 to 2.3, v=0.1 to 3 and w=0 to 30, and the relation (Fe+Co+Ti+Si)/(R1+R2)>12 is satisfied; wherein said hard magnetic compound shows a single phase consisting of a phase having a $ThMn_{12}$-type structure.

5. The hard magnetic compound according to claim 4, characterized in that said u is 0.04 to 0.06.

6. The hard magnetic compound according to claim 1 or 4, characterized in that said A is N.

7. The hard magnetic compound according to claim 1 or 4, characterized in that said x is 11 to 12.5.

8. The hard magnetic compound according to claim 1 or 4, characterized in that said z is 0.2 to 2.0.

9. The hard magnetic compound according to claim 1 or 4, characterized in that said v is 0.5 to 2.5.

10. The hard magnetic compound according to claim 1 or 4, characterized in that said w is 10 to 25.

11. A permanent magnet powder, characterized in that:

the composition of the permanent magnet powder is represented by a general formula $R(Fe_{100-y-w}Co_wTi_y)_xSi_zA_v$ (in the general formula, R is at least one element selected from rare earth elements (here the rare earth elements signify a concept inclusive of Y), Nd accounts for 50 mol% or more of said R, and A is N and/or C);

the molar ratios in said general formula are such that x=10 to 12.8, y=(8.3−1.7×z) to 12.3, z=0.1 to 2.3, v=0.1 to 3 and w=0 to 30, and the relation (Fe+Co+Ti+Si)/R>12 is satisfied;

the mean crystal grain size of the permanent magnet powder particles is 200 nm or less; and said articles show a single phase consisting of a phase substantially having a $ThMn_{12}$-type structure.

12. The permanent magnet powder according to claim 11, characterized in that Nd accounts for 70 mol% or more of said R.

13. A method for producing a permanent magnet powder, characterized by comprising the steps of:

producing a powder by quenching and solidification of a melt of alloy wherein:

the composition of the powder is represented by a general formula $R(Fe_{100-y-w}Co_wTi_y)_xSi_z$(in the general formula, R is at least one element selected from rare earth elements (here the rare earth elements signify a concept inclusive of Y), Nd accounts for 50 mol% or more of said R); and the molar ratios in said general formula are such that x=10 to 12.8, y=(8.3 −1.7×z) to 12.3, z=0.1 to 2.3 and w=0 to 30, and the relation (Fe+Co+Ti+Si)/R>12 is satisfied;

heat-treating said powder so that the powder is maintained in an inert atmosphere at 650 to 850° C. for 0.5 to 120 hours; and nitriding or carbiding said heat-treated powder.

14. The method for producing a permanent magnet powder according to claim 13, characterized in that the structure of said quenched and solidified powder is any one of an amorphous phase, a mixed phase composed of an amorphous phase and a crystalline phase and a crystalline phase.

15. The method for producing a permanent magnet powder according to claim 13, characterized in that said quenching and solidification is conducted by the single roll casting method, and the peripheral velocity of the roll in use is 10 to 100 m/s.

16. The method for producing a permanent magnet powder according to claim 13, characterized in that said heat treatment crystallizes the amorphous phase, or regulates the size of grains constituting the crystalline phase.

17. A bonded magnet comprising a permanent magnet powder and a resin phase to bind said permanent magnet powder, characterized in that:

the composition of the crystalline hard magnetic particles constituting said permanent magnet powder is represented by a general formula $R(Fe_{100-y-w}Co_wTi_y)_xSi_zA_v$ (in the general formula, R is at least one element selected from rare earth elements (here the rare earth elements signify a concept inclusive of Y), Nd accounts for 50 mol% or more of said R, and A is N and/or C);

the molar ratios in said general formula are such that x=10 to 12.8, y=(8.3 −1.7×z) to 12.3, z=0.1 to 2.3, v=0.1 and w=0 to 30, and the relation (Fe+Co+Ti+Si)/R>12 is satisfied; and the articles of said permanent magnet powder show a single phase consisting of a phase substantially having the $ThMn_{12}$-type structure.

18. The bonded magnet according to claim 17, characterized in that the mean crystal grain size of said hard magnetic particles is 200 nm or less.

* * * * *